US006892856B2

(12) United States Patent
Takahashi et al.

(10) Patent No.: US 6,892,856 B2
(45) Date of Patent: May 17, 2005

(54) SOUND RADIATING STRUCTURE, ACOUSTIC ROOM AND SOUND SCATTERING METHOD

(75) Inventors: Kengo Takahashi, Hamamatsu (JP); Tetsu Kobayashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 65 days.

(21) Appl. No.: 09/905,547

(22) Filed: Jul. 13, 2001

(65) Prior Publication Data

US 2002/0017426 A1 Feb. 14, 2002

(30) Foreign Application Priority Data

Jul. 13, 2000 (JP) ..... 2000-213324

(51) Int. Cl.[7] ..... E04B 1/82

(52) U.S. Cl. ..... 181/293; 181/284; 181/285; 181/286

(58) Field of Search ..... 181/293, 284, 181/285, 286, 287

(56) References Cited

U.S. PATENT DOCUMENTS 5,959,265 A * 9/1999 Van Ligten ..... 181/286

FOREIGN PATENT DOCUMENTS

| | | |
|---|---|---|
| JP | 5777415 | 5/1982 |
| JP | 2212896 | 8/1990 |
| JP | 7302087 | 11/1995 |
| JP | 8177142 | 7/1996 |
| JP | 10171471 | 6/1998 |

* cited by examiner

*Primary Examiner*—Shih-Yung Hsieh
(74) *Attorney, Agent, or Firm*—Pillsbury Winthrop LLP

(57) ABSTRACT

Sound radiating structure includes a plurality of pipes each defining an inner cavity along the length of the pipe. Each of the pipes has an end opening at one end and is closed at the other end with a closure. Each of the pipes also has a side opening in its one side portion. When a sound is input to the sound radiating structure, it re-radiates various sound waves through a number of the end and side openings together with reflected sound waves.

15 Claims, 26 Drawing Sheets

| PIPE NO | A1 | B1 | A2 | B2 | A3 | B3 | A4 | B4 | A5 | B5 | A6 | B6 | A7 | B7 |
|---|---|---|---|---|---|---|---|---|---|---|---|---|---|---|
| LENGTH L (mm) | 895 | 850 | 800 | 760 | 720 | 680 | 640 | 605 | 565 | 530 | 500 | 470 | 445 | 425 |
| f (Hz) | 95 | 100 | 106 | 112 | 118 | 125 | 133 | 140 | 150 | 160 | 170 | 181 | 191 | 200 |
| f − S (Hz) | 380 | 400 | 425 | 447 | 472 | 500 | 531 | 562 | 602 | 642 | 680 | 723 | 764 | 800 |
| f − L (Hz) | 253 | 267 | 283 | 298 | 315 | 333 | 354 | 375 | 401 | 428 | 453 | 482 | 509 | 533 |

FIG. 9

| PIPE NO | A1 | B1 | A2 | B2 | A3 | B3 | A4 | B4 | A5 | B5 | A6 | B6 | A7 | B7 |
|---|---|---|---|---|---|---|---|---|---|---|---|---|---|---|
| f-L(Hz) | 127 | 133 | 142 | 149 | 157 | 167 | 177 | 187 | 201 | 214 | 227 | 241 | 255 | 267 |
| MEASURED VALUE f1(Hz) | 120 | 135 | 140 | 145 | 150 | 180 | 190 | 180 | 185 | 210 | 225 | 225 | 230 | 235 |
| MEASURED VALUE f2(Hz) | 350 | 350 | 360 | 395 | 390 | 410 | 445 | 490 | 515 | 500 | 510 | 570 | 550 | 610 |
| MEASURED VALUE f3(Hz) | 850 | 1000 | 1100 | 1200 | 1000 | 1100 | 1350 | 1250 | 1600 | 1000 | 1400 | 1500 | 1200 | 1800 |

WITH SOUND RADIATING STRUCTURE

WITHOUT SOUND RADIATING STRUCTURE

SPECTROGRAM

IMPULSE RESPONSE

IMPULSE RESPONSE
TIME WAVEFORM

SOUND RADIATING STRUCTURE, ACOUSTIC ROOM AND SOUND SCATTERING METHOD

BACKGROUND OF THE INVENTION

The present invention relates to an improved sound radiating structure, acoustic room and sound scattering method.

Heretofore, there have been proposed and known various methods for obviating sound or acoustic obstacles in concert halls, auditoriums or like facilities or acoustic rooms by scattering sounds. Among such known acoustic-obstacle obviating methods is one which is characterized in that sound scattering members, each having a mountain-shaped or semicircular section, are attached to wall surfaces of the hall or like facilities so that the projecting and depressed configurations formed by the sound scattering members can control directions of reflected sounds to thereby scatter the sounds. Another known example of the acoustic-obstacle obviating methods is characterized in that sound absorbing panels are attached dispersedly to the inner wall surfaces, ceiling surface, etc. of the facilities so that acoustic impedance can be varied to promote scattering of the sounds. Still another known example of the acoustic-obstacle obviating methods is characterized in that sounds are scattered using a sound scattering structure, such as a Shroeder-type sound scattering structure, which has a surface with grooves of different depths based on a random series.

However, in the first-mentioned conventional acoustic-obstacle obviating method characterized by attaching the sound scattering members of a mountain-shaped or semicircular section to the wall surfaces of the facilities, the sound scattering members, forming the projecting and depressed configurations, tend to have a considerably great thickness. Thus, the interior space of the facilities would be greatly sacrificed if such thick sound scattering members are attached to the inner wall surfaces of the facilities. Further, if the sound scattering members of the mountain-shaped or semicircular section are attached all over the inner wall surfaces of the facilities, the interior of the facilities would result in a uniform and monotonous outer appearance. However, the projecting and depressed configuration can not be changed as desired because the sound scattering effects are afforded by such a configuration, with the result that the degree of flexibility or freedom in choosing the design is significantly limited.

In the second-mentioned conventional acoustic-obstacle obviating method characterized by the sound absorbing panels dispersedly attached to the inner wall surfaces, etc. of the facilities so as to provide alternating sound absorbing and sound reflecting regions on the wall surfaces, the sound absorbing effects of a number of the sound absorbing panels, although arranged dispersedly, would undesirably deteriorate the necessary acoustic liveness in the interior of the facilities. Further, in order to expand the frequency bands where the sound scattering effects can be obtained, it is necessary to provide various types of sound absorbing panels. In addition, this method is not satisfactory in that the sound scattering effects afforded thereby are not sufficient.

In the third-mentioned conventional acoustic-obstacle obviating method characterized by using the structure (such as the Shroeder-type sound scattering structure) having a surface with grooves of different depths, the depths of the grooves have to be sufficiently great (in effect, mote than 30 cm) in order to achieve the sound scattering effects in low frequency bands as well. The increased depths of the grooves would require a greater thickness of the structure, so that the interior space of the facilities would be sacrificed to a greater degree. Further, where the Shroeder-type sound scattering structure is employed, it would greatly influence the architectural design of the facilities due to its unique shape. In addition, because the Shroeder-type sound scattering structure would absorb low-frequency sounds, it is not suitable for applications where great sound scattering effects are to be achieved in low sound pitch ranges.

SUMMARY OF THE INVENTION

In view of the foregoing, it is an object of the present invention to provide a sound radiating structure which can afford good sound scattering effects across wide frequency bands without involving an increase in thickness of the structure and a decrease in the degree of flexibility in architecturally designing the interior of facilities where the sound radiating structure is installed, and an acoustic room equipped with such a sound radiating structure.

It is another object of the present invention to provide a sound scattering method which can afford good sound scattering effects across wide frequency bands without involving an increase in thickness of a sound scattering structure used and a decrease in the degree of flexibility in architecturally designing the interior of facilities where the sound scattering structure is installed.

In order to accomplish the above-mentioned objects, the present invention provides a sound radiating structure which comprises a plurality of cavity-defining members. Each of the cavity-defining members has a hollow shape to define an inner cavity that extends in a particular direction, and the inner cavity defined by each of the cavity-defining members has a length in the particular direction different from the lengths of the inner cavities defined by the other cavity-defining members. The inner cavity defined by each of the cavity-defining members opens outwardly at least one of the opposite ends of the cavity-defining member. The inner cavities defined by the cavity-defining members are located adjacent to each other. When a sound wave is input to the sound radiating structure, each of the cavity-defining members re-radiates the sound wave by resonance.

The plurality of cavity-defining members are disposed so as to adjoin each other perpendicularly to the particular direction in which the inner cavities defined thereby extend.

In one embodiment, the sound radiating structure of the invention further comprises a support panel, and the plurality of cavity-defining members are supported on the support panel.

In another embodiment, the inner cavity defined by each of the cavity-defining members opens outwardly at one of the opposite ends of the cavity-defining member and is closed at the other end of the cavity-defining member.

In another preferred implementation of the invention, the inner cavity defined by each of the cavity-defining members opens outwardly at the opposite ends of the cavity-defining member, and each of the cavity-defining members includes a detachable closure provided at least one of the opposite ends for closing the inner cavity at the at least one end.

In still another preferred implementation of the invention, each of the cavity-defining members is constructed in such a manner that the inner cavity defined thereby is adjustable in the length in the particular direction.

In another embodiment, each of the cavity-defining members has a side portion extending along the particular direction, and the side portion has a side opening formed therein and communicating with the inner cavity defined by the cavity-defining member. The side portion of each of the cavity-defining members has a flat outer surface, and the plurality of cavity-defining members are disposed in such a manner that the flat outer surfaces of the side portions in the plurality of cavity-defining members together constitute a single substantially-continuous flat outer surface of the sound radiating structure.

According to another aspect of the present invention, there is provided an acoustic room which comprises: a sound radiating structure as recited above; and an inner wall surface or ceiling surface for installation thereon of the sound radiating structure.

According to another aspect of the present invention, there is provided a sound scattering method which comprises scattering a sound using sound re-radiation based on resonance of a resonant structure.

BRIEF DESCRIPTION OF THE DRAWINGS

For better understanding of the object and other features of the present invention, its preferred embodiments will be described hereinbelow in greater detail with reference to the accompanying drawings, in which:

FIG. 9 is a graph showing lengths and theoretical values of resonant frequencies of the individual pipes employed in experiments for verifying advantageous effects attained by the sound radiating structure of FIG. 5;

DETAILED DESCRIPTION OF THE PREFERRED EMBODIMENTS

A. Construction of Embodiment

Figure 1:
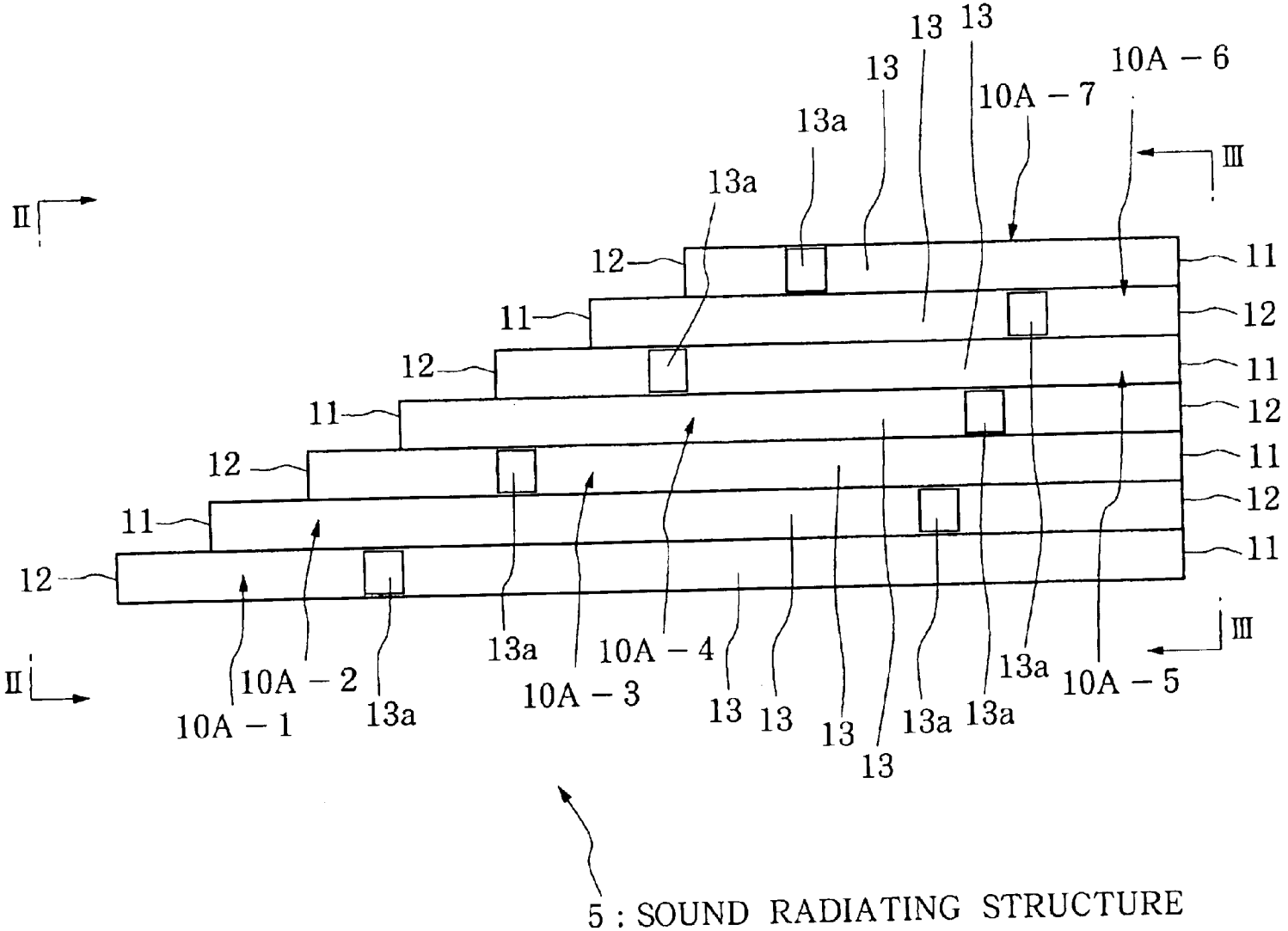
FIG. 1 is a front view of a sound radiating structure in accordance with en embodiment of the present invention.

FIG. 1 is a front view of a sound radiating structure 5 in accordance with en embodiment of the present invention. As shown, the sound radiating structure 5 comprises a plurality of (seven in the illustrated example) pipes (hollow cavity-defining members) 10-A1 to 10-A7. The sound radiating structure 5 will hereinafter be described as comprising seven pipes, for convenience of description.

The seven pipes 10-A1 to 10-A7 are disposed in a parallel side-by-side relation to each other (i.e., in such a manner that the pipes adjoin each other in a direction perpendicular to the length of the pipes or in a top-and-bottom direction of FIG. 1). Each of the pipes has a length different from those of the other pipes. Specifically, the lengths of the pipes 10-A1 to 10-A7 decrease progressively in the bottom-to-top direction of FIG. 1; that is, the pipe 10-A1 has the greatest length, the pipe 10-A2 has the second greatest length, and the pipe 10-A7 has the smallest length. The pipes 10-A1 to 10-A7 are aligned at their respective one (right in the illustrated example) ends. In this way, the other (left in the illustrated example) ends of the pipes 10-A1 to 10-A7 having such different lengths together form a stairway-like stepwise configuration. Although the pipes 10-A1 to 10-A7 are illustrated as having their lengths decreasing progressively, the order of arrangement of these pipes is not necessarily so limited and may be chosen arbitrarily. However, it is preferable that the pipes 10-A1 to 10-A7 be arranged in such order to form a stairway-like stepwise configuration at one of the opposite ends as mentioned above, because the stairway-like stepwise configuration can make the sound radiating structure 5 neat in outer appearance. Because the length of each of the pipes is a factor determining a frequency band of the pipe, arranging the pipes of different lengths as in the instant embodiment can constitute an efficient sound radiating structure capable of properly processing sounds in wider frequency bands, as will be later described in detail.

Figure 2:
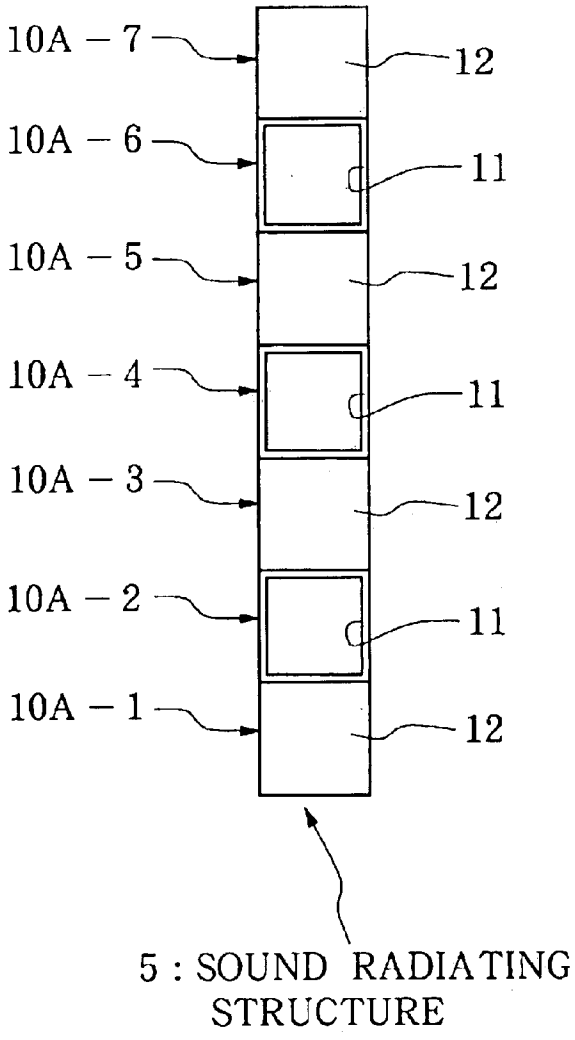
FIG. 2 is a view of the sound radiating structure taken along the lines II—II of FIG. 1.
Figure 3:
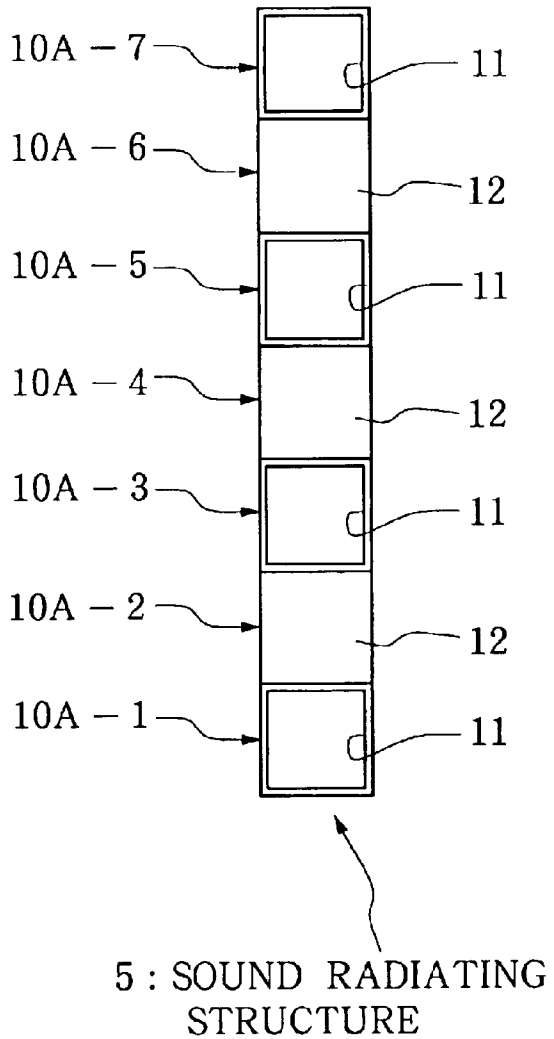
FIG. 3 is a view of the sound radiating structure taken along the lines III—III of FIG. 1.

As seen in FIGS. 1, 2 and 3, each of the pipes 10-A1 to 10-A7 constituting the sound radiating structure 5 is a tubular member that has a substantially square cross-sectional shape to thereby form an inner cavity having a substantially square cross-sectional shape and extending along the length of the pipe. In this instance, it is preferable that each of the pipes, having such an inner cavity, have a small wall thickness as long as a predetermined mechanical strength of the pipe can be assured.

As noted earlier, the pipes 10-A1 to 10-A7 are disposed side by side, i.e. positioned to be adjacent to each other in the direction perpendicular to the length of the pipes or in the top-and-bottom direction of FIG. 1. Further, in this instance, all of the pipes 10-A1 to 10-A7, each generally in the shape of a hollow rectangular parallelepiped, are disposed side by side in such a manner that their respective one flat side portions 13 together form a substantially-continuous flat outer surface of the sound radiating structure 5. Namely, by virtue of such side-by-side arrangement of the pipes, the sound radiating structure 5 of the invention has an outer appearance having a generally flat outer surface.

Each of the pipes 10-A1 to 10-A7 is open at one of its opposite ends to provide an end opening 11, and has the other end closed by a lid or closure 12. In this case, every second pipes 10-A2, 10-A4, 10-A6 and 10-A8 have the end openings 11 at their ends forming the stepwise configuration (see FIG. 2) and are closed with the closures 12 at their opposite or aligned ends (see FIG. 3). The remaining pipes 10-A1, 10-A3, 10-A5 and 10-A7, on the other hand, have the end openings 11 at their aligned ends and are closed with the closures 12 at their other ends forming the stepwise configuration. Namely, the seven pipes 10-A1 to 10-A7 are arranged in such a manner that the end openings 11 appear in a staggering fashion. In other words, the end openings 11 and closed ends with the closures 12 alternate at each one of the ends of the sound radiating structure 5, and thus the end openings 11 are staggered between the adjoining pipes. Note that although the pipes 10-A1 to 10-A7 may be placed in any other suitable orientations than the above-mentioned, the pipes 10-A1 to 10-A7 in the instant embodiment are preferably orientated such that the end openings 11 are staggered between the adjoining pipes as above, so as to scatter positions of side openings 13*a* as will be later described in detail.

Figure 4:
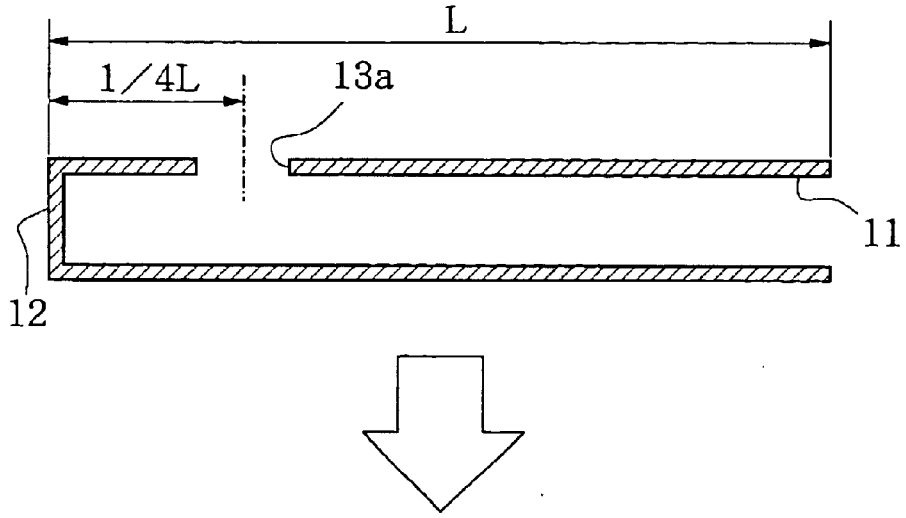
FIGS. 4A and 4B are views explanatory of a resonant frequency of each pipe in the sound radiating structure of FIG. 1.
Figure 4:
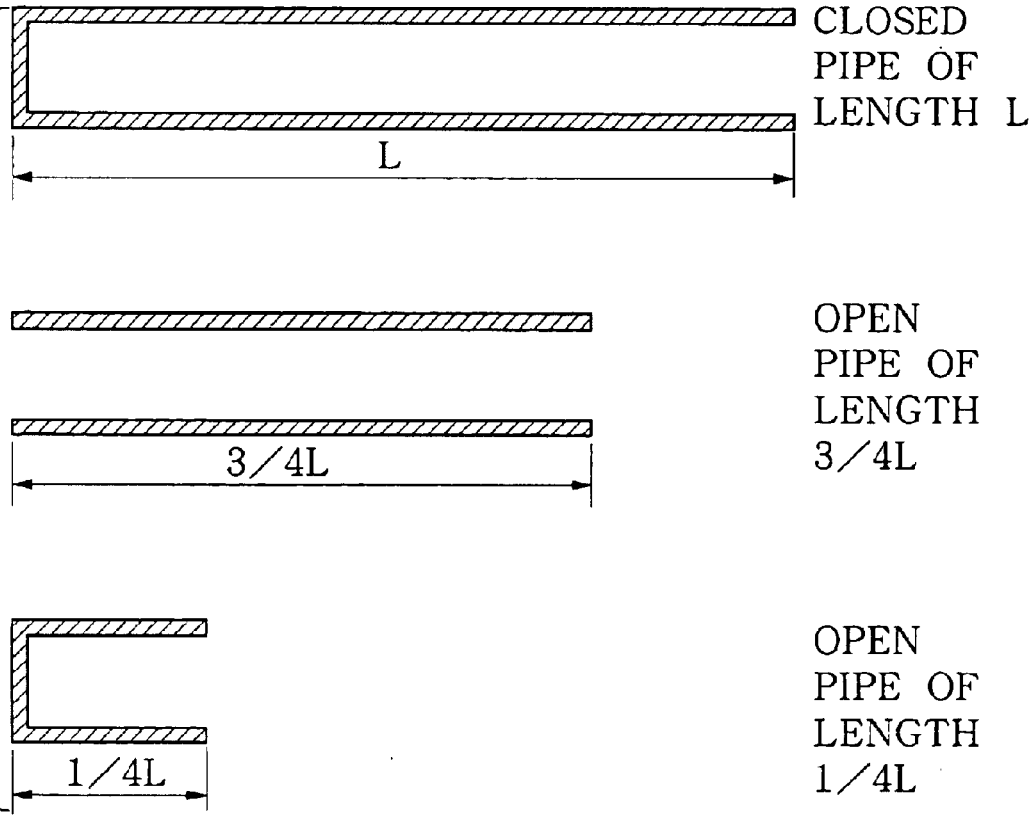

Each of the pipes 10-A1 to 10-A7, constituting the sound radiating structure 5, has the side opening 13*a* formed in the above-mentioned flat-surface-forming side portion 13 and communicating with the inner cavity of the pipe. As shown in FIG. 4A, the side opening 13*a* of each of the pipes 10-A1 to 10-A7 is formed in the side portion 13 at a position corresponding to three quarters of the length L of the pipe as measured from the open end 11 (i.e., at a position corresponding to one quarter of the length L as measured from the end closed with the closure 12).

B. Modified Construction

Figure 5:
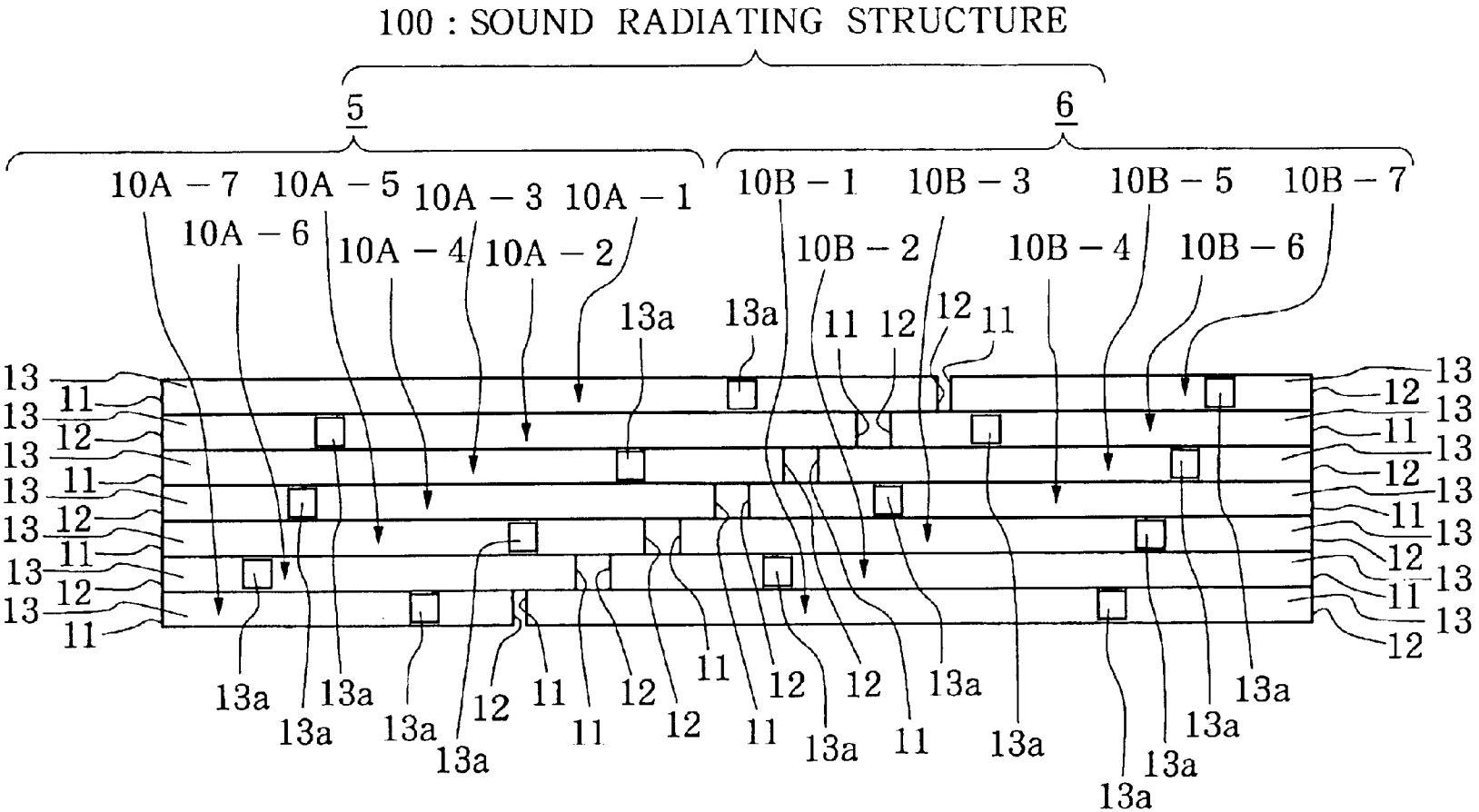
FIG. 5 is a front view of a sound radiating structure in accordance with another embodiment of the present invention.

Whereas the sound radiating structure 5 has been described as comprising seven pipes disposed side by side, a sound radiating structure 100 may be constructed, as another embodiment of the invention, by combining the above-described sound radiating structure (hereinafter called a "first sound radiating structure") 5 with another sound radiating structure (hereinafter called a "second sound radiating structure) 6 also comprising the same number of pipes (cavity-defining members) 10-B1 to 10-B7 as the first sound radiating structure, as illustrated in FIG. 5. As seen in FIG. 5, the first and second sound radiating structures 5 and 6 in the structure (hereinafter also called a "combined-type sound radiating structure") 100 are disposed in series with each other.

Similarly to the first sound radiating structure 5 described above, the seven pipes 10-B1 to 10-B7 of the second sound radiating structure 6 are disposed in a parallel or side-by-side relation to each other (i.e. positioned to adjoin each other in the direction perpendicular to the length of the pipes). These pipes 10-B1 to 10-B7 have lengths decreasing progressively in the bottom-to-top direction of FIG. 5; that is, the pipe 10-B1 at the bottom has the greatest length, the pipe 10-B2 has the second greatest length, and the pipe 10-B7 at the top has the smallest length. The pipes 10-B1 to 10-B7 are aligned at their respective one (right in the illustrated example) ends remote from the first sound radiating structure 5. In this way, the other (left in the illustrated example) ends of the pipes 10-B1 to 10-B7, which are opposed to the stepwise ends of the pipes in the first radiating structure 5, together form a stairway-like stepwise configuration. The first and second sound radiating structures 5 and 6 are disposed in series with each other with the vertical orientations of the structures 5 and 6 being opposite from each other in such a manner that their respective stepwise ends substantially mesh with each other. More specifically, the pipes 10-A7 to 10-A1 of the first sound radiating structures 5 arranged in ascending order of the pipe length are opposed to the pipes 10-B1 to 10-B7, respectively, of the second sound radiating structures 6 arranged in descending order of the pipe length. Although, as stated in relation to the first sound radiating structure 5, the pipes 10-B1 to 10-B7 of the second sound radiating structure 6 need not be necessarily arranged in such order that their lengths vary progressively, the arrangement of the 10-B1 to 10 pipes in the above-mentioned order is preferable in that the respective stepwise ends of the first and second sound radiating structures 5 and 6 substantially mesh with each other. As a consequence, the sound radiating structure 100 comprising the combination of the first and second sound radiating structures 5 and 6 has a rectangular shape as a whole as viewed in plan, and thus can have a neat outer appearance. In addition, such a combined-type sound radiating structure 100 can be installed snugly in an acoustic room etc. with an enhanced degree of flexibility. Further, in the case where the sound radiating structures and are combined as in the sound radiating structure 100, a great number of the pipes of different lengths can be arranged efficiently.

Similarly to the first sound radiating structure 5, all of the pipes 10-B1 to 10-B7, each generally in the shape of a hollow rectangular parallelepiped, are disposed in such a manner that their respective one side portions 13 together form a generally-continuous flat outer surface of the second sound radiating structure 6. The flat surface of the second sound radiating structure 6 lie flush with the flat surface of the first sound radiating structure 5, so as to provide a generally-continuous flat outer surface of the entire combined-type sound radiating structure 100. The combined-type sound radiating structure 100 is installed in a desired acoustic room or the like with the thus-formed outer flat surface facing the interior of the acoustic room.

The second sound radiating structure 6 is generally similar in construction to the above-mentioned first sound radiating structure 5 except that the orientation (vertical orientation in the figure) of the radiating structure 6 is opposite to that of the radiating structure 5 and that the horizontally opposed pipes of the two radiating structures 5 and 6 have different lengths. Namely, each of the pipes 10-B1 to 10-B7 of the second sound radiating structure 6 is open at one of its ends to provide an end opening 11, and has the other end closed by a lid or closure 12. Further, the pipes 10-B1 to 10-B7 of the second sound radiating structure 6 are orientated such that the end openings 11 are staggered between the adjoining pipes. In addition, each of the pipes 10-B1 to 10-B7, constituting the second sound radiating structure 6, has a side opening 13*a* formed in the above-mentioned flat-surface-forming side portion 13 and communicating with the inner cavity of the pipe, and the side opening 13*a* of each of the pipes 10-B1 to 10-B7 is located at a position corresponding to three quarters of the length L of the pipe as measured from the open end 11 (i.e., at a position corresponding to one quarter of the length L as measured from the end closed with the closure 12). The inner cavity of each of the pipes 10-B1 to 10-B7 in the second sound radiating structure 6 also has the same cross-sectional shape as that in the first sound radiating structure 5.

In the embodiment of FIG. 5, the lengths of the pipes in the second sound radiating structure 6 differ from the lengths of the pipes in the first sound radiating structure 5. Because, as previously noted, the length of each of the pipes is a factor determining a frequency band of the pipe capable of obtaining good sound scattering characteristics, the combination of the first and second sound radiating structures 5 and 6 with a multiplicity of the pipes having different lengths achieves better sound scattering characteristics across wider frequency bands.

C. Installation of Sound Radiating Structure

Figure 6:
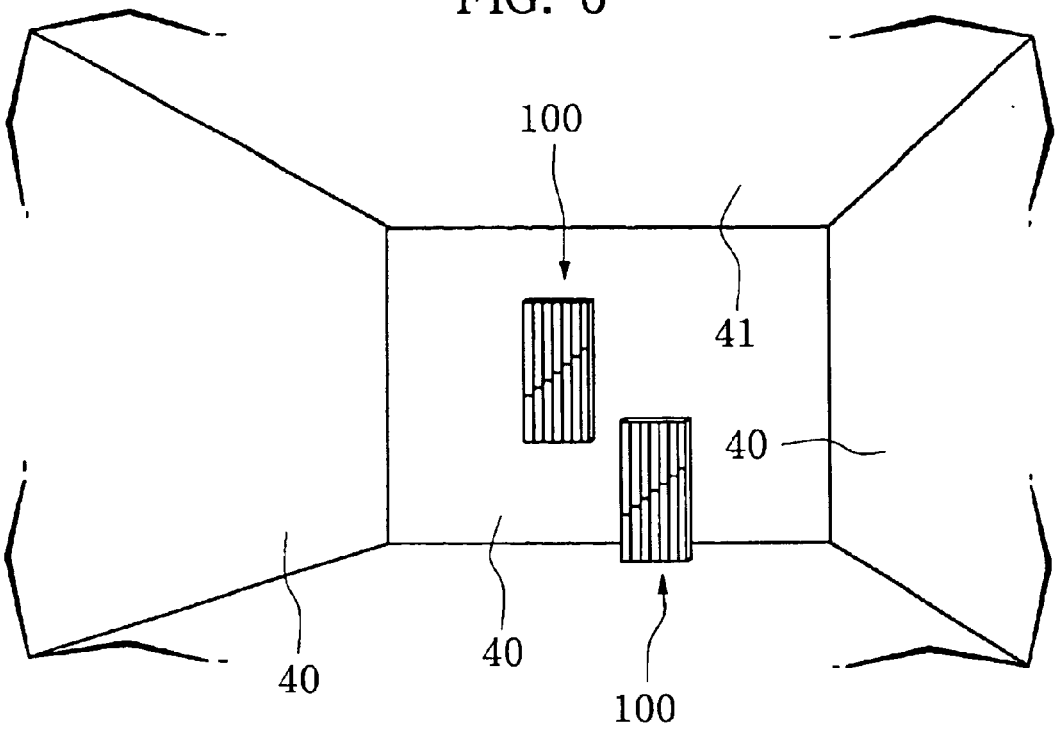
FIG. 6 is a view showing an example of a manner in which the sound radiating structure of the invention is installed in an acoustic room.

Now, a description will be made about a manner in which the above-described sound radiating structure 5 (or 6) and the sound radiating structure 100 comprising the combination of the first and second sound radiating structures 5 and 6 are installed in the acoustic room, with reference to FIGS. 6 to 8. Specifically, FIG. 6 shows cases where the combined-type sound radiating structure 100 is attached to one of the side wall surfaces 40 of the acoustic room and where the combined-type sound radiating structure 100 is provided on the floor of the acoustic room adjacent to the side wall surface 40. Although the combined-type sound radiating structure 100 may be provided on one of the side wall surfaces 40 or on the floor adjacent to the side wall surface 40 as illustrated, it is preferable to install the sound radiating structure 100 near the center of the side wall surface 40 in that the radiating structure 100 thus positioned can present satisfactory sound scattering characteristics. Because, in the acoustic room generally in the shape of a hollow rectangular parallelepiped, areas near the center of the side wall surface 40 are where repeated reflection (i.e., flutter) easily occurs between the parallel opposed wall surfaces, and therefore good sound scattering characteristics can be obtained by the combined-type sound radiating structure 100 installed near the center of the side wall surface 40 as illustrated.

Figure 7:
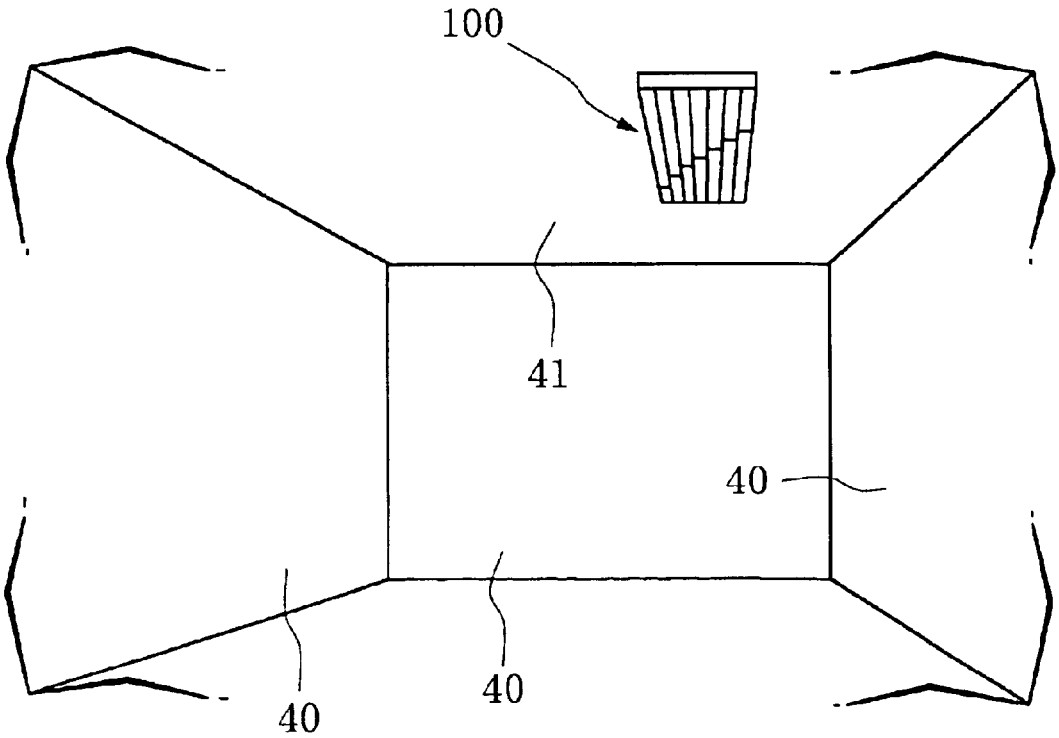
FIG. 7 is a view showing another example of the manner in which the sound radiating structure of the invention is installed in an acoustic room.

In an alternative, the combined-type sound radiating structure 100 may be attached to a ceiling surface 41 of the acoustic room, as illustrated in FIG. 7. In this case, it is preferable to install the sound radiating structure 100 near the center of the ceiling surface 41 for the same reason as stated above in relation to the installation of the structure 100 on the side wall surface 40. In another alternative, the combined-type sound radiating structures 100 may be installed on both the ceiling surface 41 and the side wall surface 40, as illustrated in FIG. 8. Further, the combined-type sound radiating structure 100 may be installed either in an orientation where the length or longitudinal direction of the pipes generally coincides with the horizontal direction or in an orientation where the length or longitudinal direction of the pipes generally coincides with the vertical direction, or may be installed in any other desired orientation.

D. Benefits Attained by the Inventive Sound Radiating Structure

Figure 8:
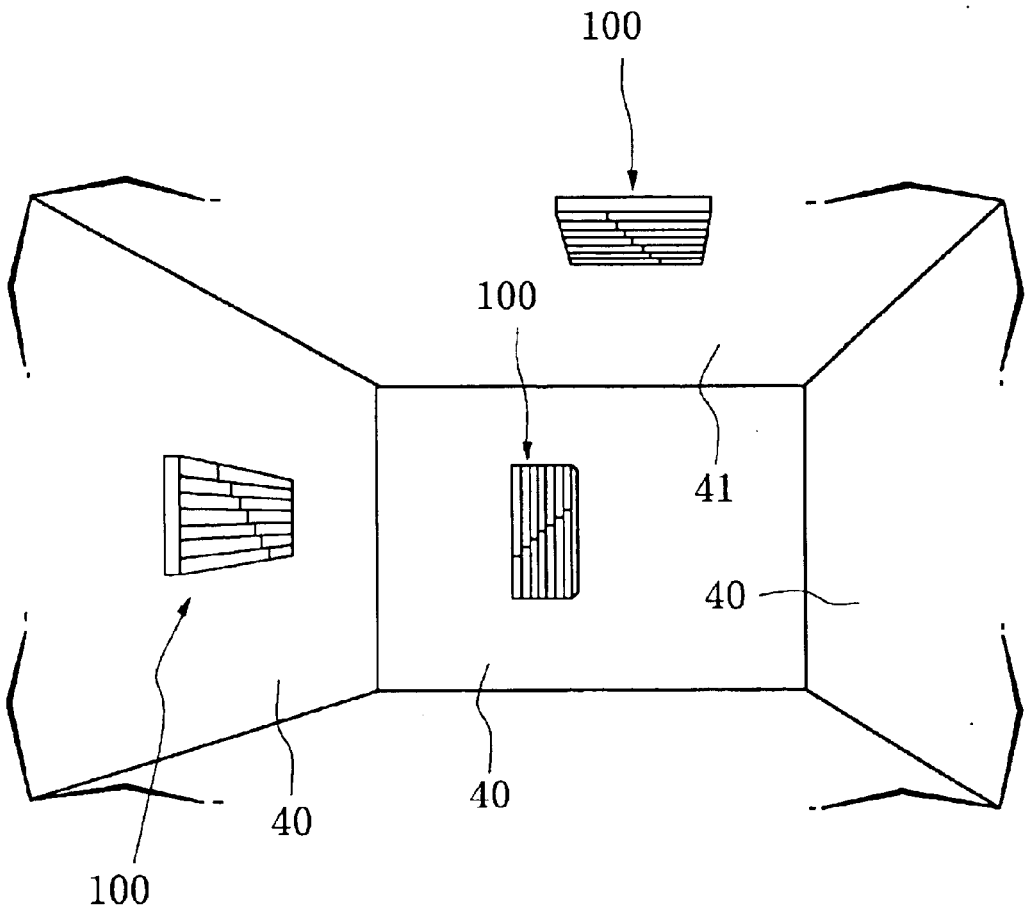
FIG. 8 is a view showing still another example of the manner in which the sound radiating structure of the invention is installed in an acoustic room.

By being installed on the wall, floor, ceiling surface or the like as illustrated in FIG. 6, 7 or 8, the above-described sound radiating structure, constructed in accordance with the present invention, can effectively scatter sounds making use of acoustic re-radiation by the pipes that function as resonant pipes acting on input sounds, and thereby minimize acoustic obstacles such as flutter echo. More specifically, as a sound wave is input to the inventive sound radiating structure, the sound radiating structure is excited by the input sound wave to produce acoustic radiation. Because the sound radiating structure has a plurality of the inner cavities of different lengths, acoustic re-radiation is produced by resonant sounds of frequencies corresponding to the lengths of the inner cavities. In this way, there can be produced effective acoustic re-radiation with time delays, which can lessen or minimize the above-mentioned acoustic obstacles. The following paragraphs describe in greater detail the principles on which the combined-type sound radiating structure 100 scatters sounds in order to minimize the acoustic obstacles. The following description is made only in relation to the combined-type sound radiating structure 100, because the other sound radiating structures 5 and 6 operate to scatter sounds on the same principles as the combined-type sound radiating structure 100.

The sound radiating structure 100 is installed on a boundary surface, such as an inner wall surface or ceiling surface, of an acoustic room which is normally subjected to high sound pressures. When a sound wave is input, from a central area of the acoustic room, to the sound radiating structure 100 installed on such a wall surface or the like, there is produced, in the cavity of each of the pipes constituting the radiating structure 100, a standing wave corresponding to a resonant frequency of the pipe. As a consequence, a sound wave having the resonant frequency of the pipe is re-radiated as a spherical wave from the openings of each of the pipes. Because, as noted earlier, the sound radiating structure 100 includes a number of the pipes having different lengths and hence different resonant frequencies, the radiating structure 100 is capable of re-radiating sound waves across wide frequency bands.

Further, as described above, each of the pipes constituting the radiating structure 100 is not just a closed pipe with the opening 11 at one end thereof, but also has the side opening 13*a* formed in the side portion 13 thereof. Namely, from the viewpoint of acoustics, each of the pipes constituting the sound radiating structure 100 can be regarded as comprising three pipe portions: a closed pipe portion having the length L; an open pipe portion having three quarters of the length L (¾ L) and opening at opposite ends; and a closed pipe portion having one quarter of the length L (¼ L), as seen in FIG. 4B. This way, each of the pipes has three different resonant frequencies: the resonant frequency of the closed pipe portion having the length L; the resonant frequency of the open pipe portion having ¾ of the length L; and the resonant frequency of the closed pipe portion having ¼ of the length L, so that sound waves of these three different resonant frequencies are re-radiated through the end and side openings 11 and 13*a* of each or the pipes in the sound radiating structure 100.

The sound waves of the various frequencies re-radiated from the sound radiating structure 100 are produced in addition to and immediately following reflected sound waves produced by the input sound wave being reflected off the surface of the radiating structure 100. Further, sound waves having different frequencies can be radiated through the pipe openings formed at various positions of the sound radiating structure 100. This situation is acoustically equivalent to a case where a number of spot sound sources of different frequencies are installed on a wall surface or the like, and thus the sound radiating structure 100 of the present invention can implement an effective sound scattering process on each input sound. Namely, because the sound radiating structure 100 performs the sound scattering process utilizing acoustic re-radiation accompanied by some time delays rather than absorbing input sounds, it can effectively prevent an increase in the sound absorption rate and hence avoid undesired deterioration of the acoustic liveness in the interior of the acoustic room.

It should be appreciated that the sound radiating structure 100 based on the above-described principles can effectively perform the sound scattering process over wide frequency bands. The inventors of the present inventor conducted various measurement and experiments as will be described below and has confirmed that the sound radiating structure 100 of the present invention constructed in the above-described manner can present superior sound scattering performance. The following paragraphs describe detailed contents, results, etc. of these measurement and experiments.

FIG. 9 is a graph showing the different lengths of the individual pipes constituting the sound radiating structures 5 and 6 which were employed in the measurement and experiments, and theoretical values of the resonant frequencies of the closed pipe portions (i.e., pipe portions closed at one end and open at the other end) of the pipes having different lengths. Note that the cross section of each of the pipes has a square shape and a size of 60 mm×60 mm and each of the pipes has the inner cavity smaller than the 60 mm×60 mm size by the wall thickness of the pipe. In FIG. 9, pipe Nos. A1, A2, . . . , A7 represent the above-mentioned pipes 10-A1 to 10-A7, while pipe Nos. B1, B2, . . . , B7 represent the above-mentioned pipes 10-B1 to 10-B7. Further, "f" represents a theoretical value of the resonant frequency of the closed pipe having the length L, "f-S" represents a theoretical value of the resonant frequency of the closed pipe portion having the length ¼ L, and "f-L" represents a theoretical value of the resonant frequency of the open pipe portion having the length ¾ L. As shown in the graph, the sizes of the individual pipes in the sound radiating structure 100 of the present invention are chosen such that the radiating structure 100 can re-radiate sound waves of resonant frequencies in an approximate range of 100 Hz–1 kHz and thus cover wide frequency bands.

First, a microphone was placed right in front of each of the openings of the pipes, in order to ascertain whether each of the pipes was re-radiating sounds of three different resonant frequencies. Then, on the basis of results obtained through the individual microphones, it was confirmed that a peak frequency value found as a result of the experiments substantially coincides with the theoretical value (f) of the resonant frequency of the closed pipe portion having the length L and the theoretical value (f-S) of the resonant frequency of the closed pipe portion having the length ¼ L.

Figures 10A, 10B:
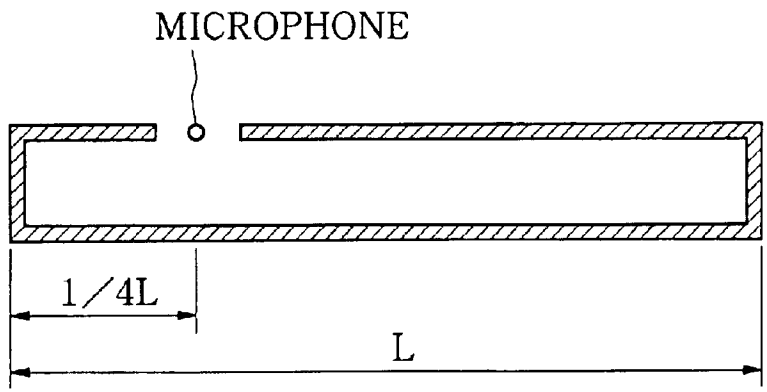
FIG. 10A is a view explanatory of an experiment for determining the resonant frequencies of the individual pipes.
FIG. 10B is a graph showing peak values of frequency characteristics measured by the experiment.

Further, in the measurement and experiments conducted on the resonant frequency of the open pipe portion having the length ¾ L, a side opening was formed at a position corresponding to three quarters of the length L (¾ L) of a pipe closed at opposite ends, and a microphone was placed right in front of the thus-formed side opening to measure a radiated sound from the opening, as shown in FIG. 10A. In this case, there were obtained results as shown FIG. 10B. Here, the theoretical value (f-L') of the resonant frequency of the pipe closed at its opposite ends equaled one half of the value (f-L). Taking this into account, a first frequency peak value obtained by the measurement was compared to the theoretical value (f-L') equal to one half of the theoretical value (f-L) (see FIG. 9), and the comparison ascertained that the compared two values substantially matched each other.

Thus, it was confirmed that each of the pipes in the sound radiating structure 100 was radiating sound waves of three resonant frequencies, from which it can be seen that the radiating structure 100 can realize an effective sound scattering process over the wide frequency range of 100 Hz–1 kHz. Although the fundamental resonant frequencies of the individual pipes are in the range of 100 Hz–1 kHz, the sound scattering process can be performed effectively in frequency bands higher than 100 Hz if high-order harmonics are taken into consideration, as shown in FIG. 10B.

Figure 11A:
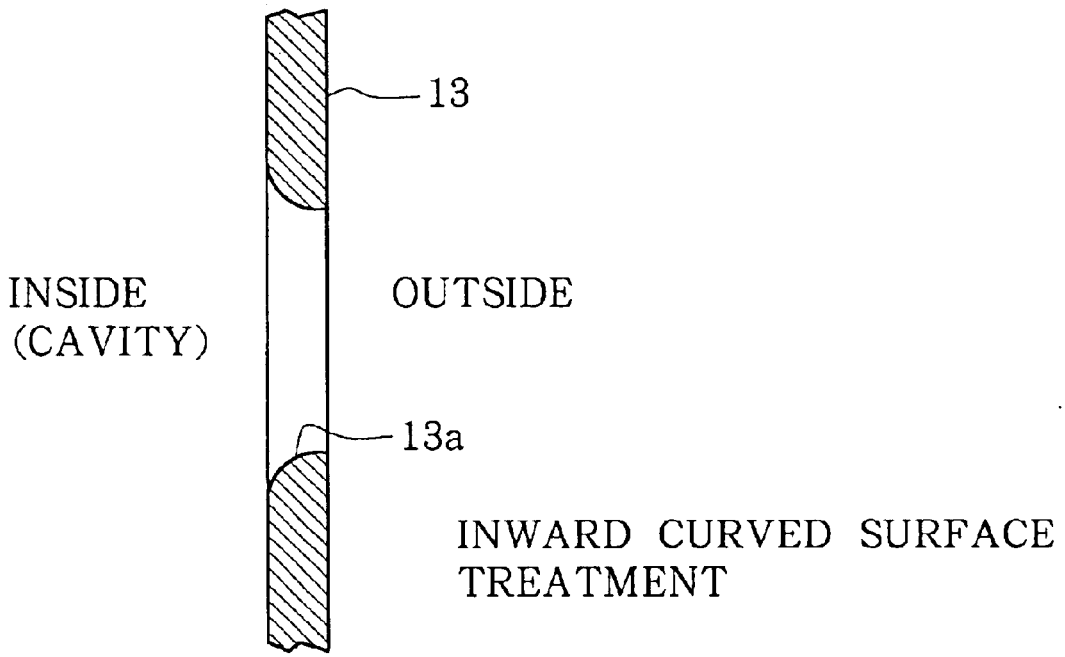
FIG. 11A is a view showing an inward curved surface formed on an edge of a side portion of each of the pipes constituting the sound radiating structure.
Figure 11B:
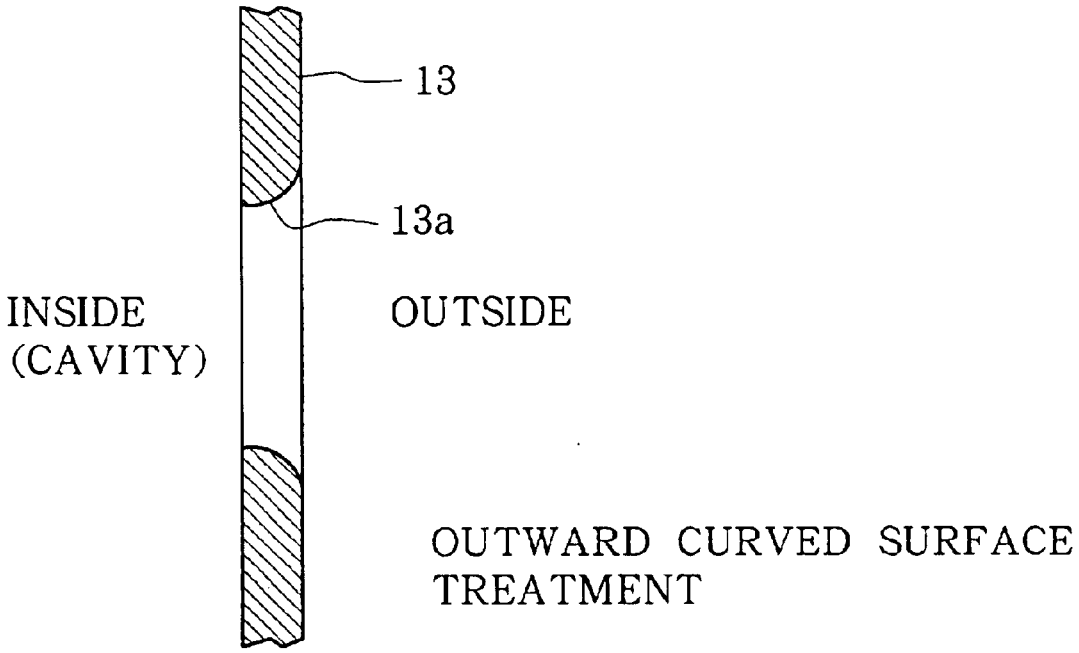
FIG. 11B is a view showing an outward curved surface formed on the edge of the side portion of each of the pipes.

As stated above, each of the side openings 13*a* in the sound radiating structure 100 is located at a position corresponding to three quarters of the pipe length (i.e., ¾ L) as measured from the open end 11 of the pipe. Further, it is preferable that in the sound radiating structure 100, the wall thickness of each of the pipes, where the end opening 11 is formed, be as small as possible. In order to confirm that such arrangements of the sound radiating structure 100 can yield good sound scattering effects, the inventors of the present invention conducted sound wave motion simulation in relation to three viewpoints: wall thickness of the pipe (Case 1); formation of an "outward" or "inward" curved surface on an edge of the side portion 13 defining the side opening 13*a* (Case 2); and position of the side opening 13*a* (Case 3). In the experiment, a plane wave sound source is placed in the interior of a closed room generally in the shape of a rectangular parallelepiped, a sound radiating structure constructed in a manner as set forth below was installed on one of the wall surfaces of the closed room, and then sound energy distribution in such settings was derived. Now, a description is given about the formation of the "outward" or "inward" curved surface on the edge of the side portion 13 defining the side opening 13*a*, with reference to FIG. 11; specifically, FIG. 11A is a sectional view showing how the inward curved surface was formed on the edge of the side portion 13, while FIG. 11B is a sectional view showing how the outward curved surface was formed on the edge of the side portion 13. As can be seen from these figures, the inward curved surface was formed on the edge of the side portion 13 defining the side opening 13*a* to gradually curve in a direction toward the inner surface or inner cavity of the pipe, i.e. in such a manner that the size of the side opening 13*a* gradually becomes greater in the direction toward the cavity of the pipe, and the outward curved surface was formed on the edge of the side portion 13 defining the side opening 13*a* to gradually curve in a direction toward the outer surface or outside of the pipe, i.e. in such a manner that the size of the side opening 13*a* gradually becomes greater in the direction toward the outside.

The above-mentioned experiment conducted in relation to such viewpoints yielded results as illustrated in FIGS. 12 to 19. Note that FIGS. 12 to 19 were prepared by monochromatically printing, on sheets of paper, computer graphics indicating the results of the simulation which normally should be displayed as colored images on a computer display device. Because such figures can not reproduce details of the simulation results, some supplemental remarks are added to the figures about the sound energy distribution. Further, vertical bars on the right of the figures each indicate correspondency between sound pressure values and colors displayed on the distribution chart; shades of color in the upper regions of the bar represent greater sound pressure values, while shades of color in the lower regions of the bar represent smaller sound pressure values.

(Case 1-A)

Figure 12:
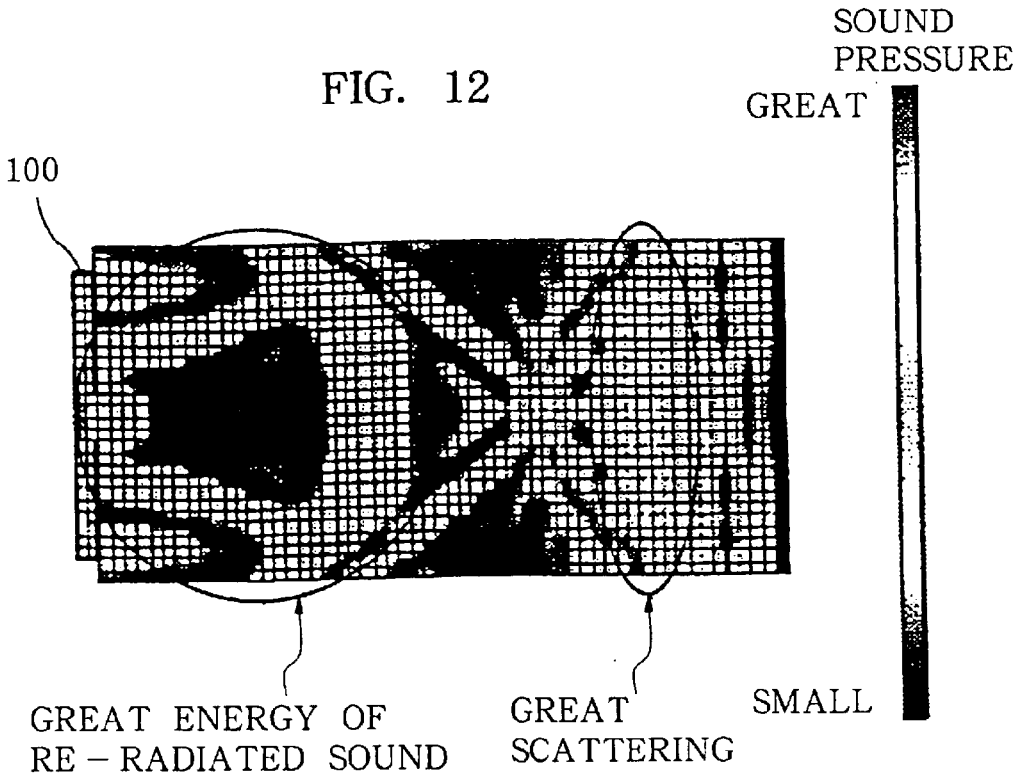
FIG. 12 is a view showing an example of energy distribution derived by sound motion simulation for determining sound scattering characteristics of the sound radiating structure.

Sound radiating structure where each of the pipes has a small wall thickness (see FIG. 12).

(Case 1-B)

Figure 13:
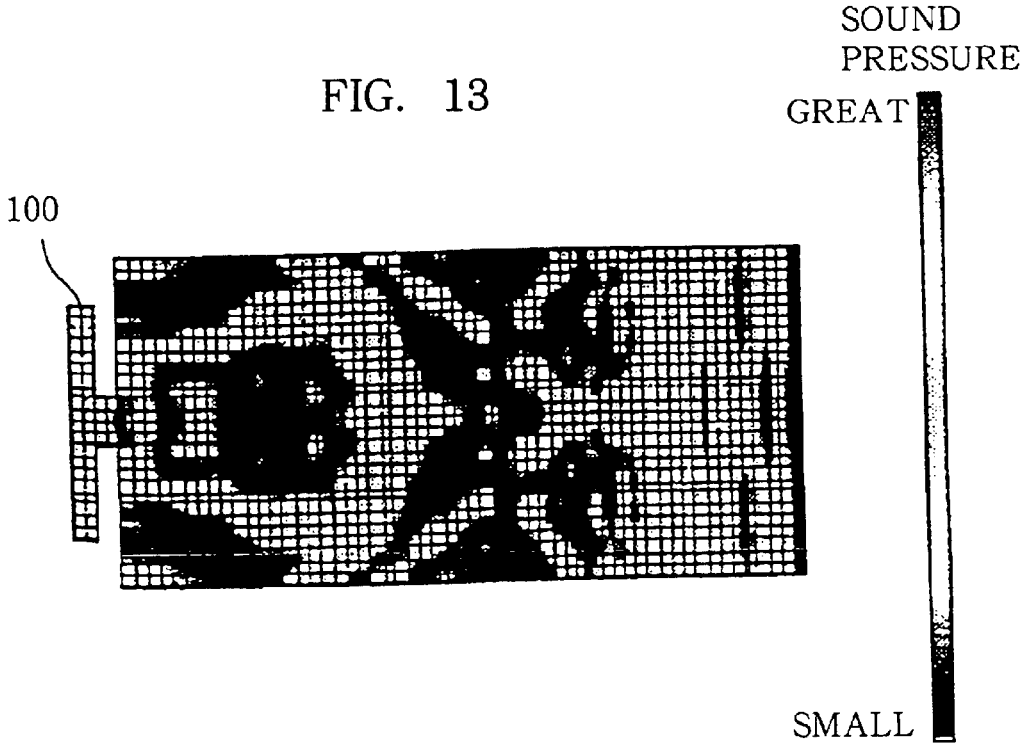
FIG. 13 is a view showing another example of energy distribution derived by the sound motion simulation for determining sound scattering characteristics of the sound radiating structure.

Sound radiating structure where each of the pipes has a great wall thickness (see FIG. 13).

(Case 2-A)

Figure 14:
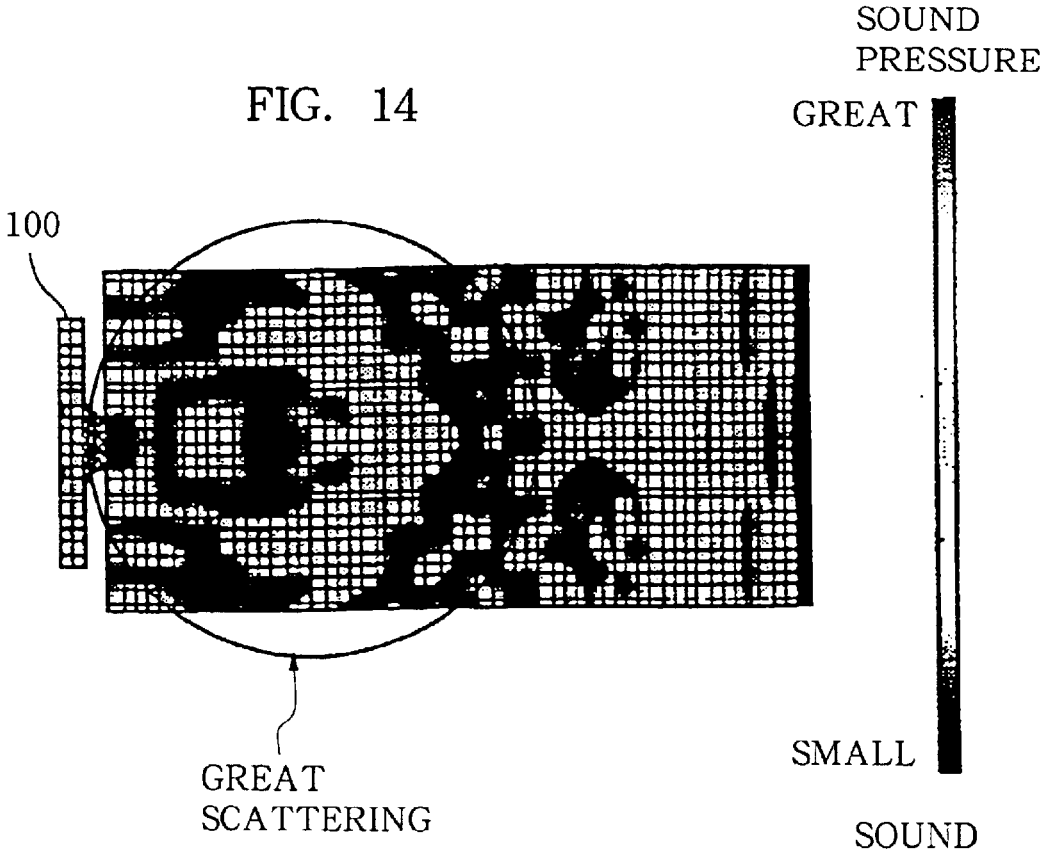
FIG. 14 is a view showing still another example of energy distribution derived by the sound motion simulation for determining sound scattering characteristics of the sound radiating structure.

Sound radiating structure where each of the pipes has the inward curved surface on the edge defining the side opening 13*a* (see FIG. 14).

(Case 2-B)

Figure 15:
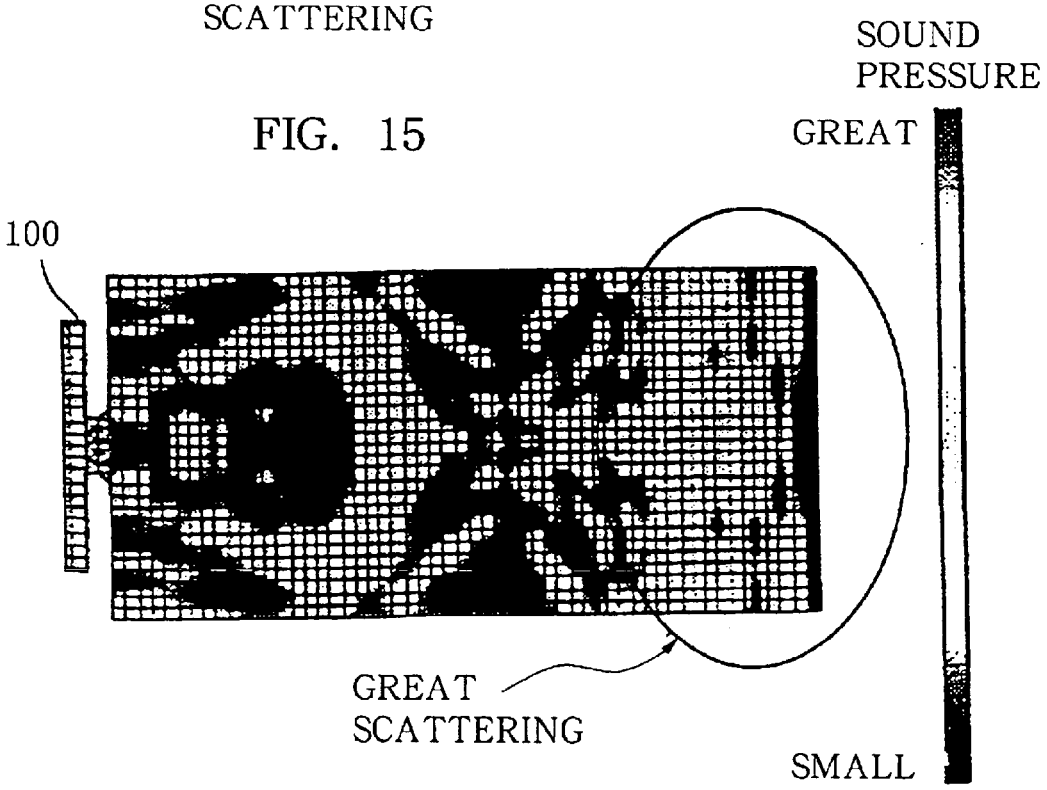
FIG. 15 is a view showing still another example of energy distribution derived by the sound motion simulation for determining sound scattering characteristics of the sound radiating structure.

Sound radiating structure where each of the pipes has the outward curved surface on the edge defining the side opening 13*a* (see FIG. 15).

(Case 3-A)

Figure 16:
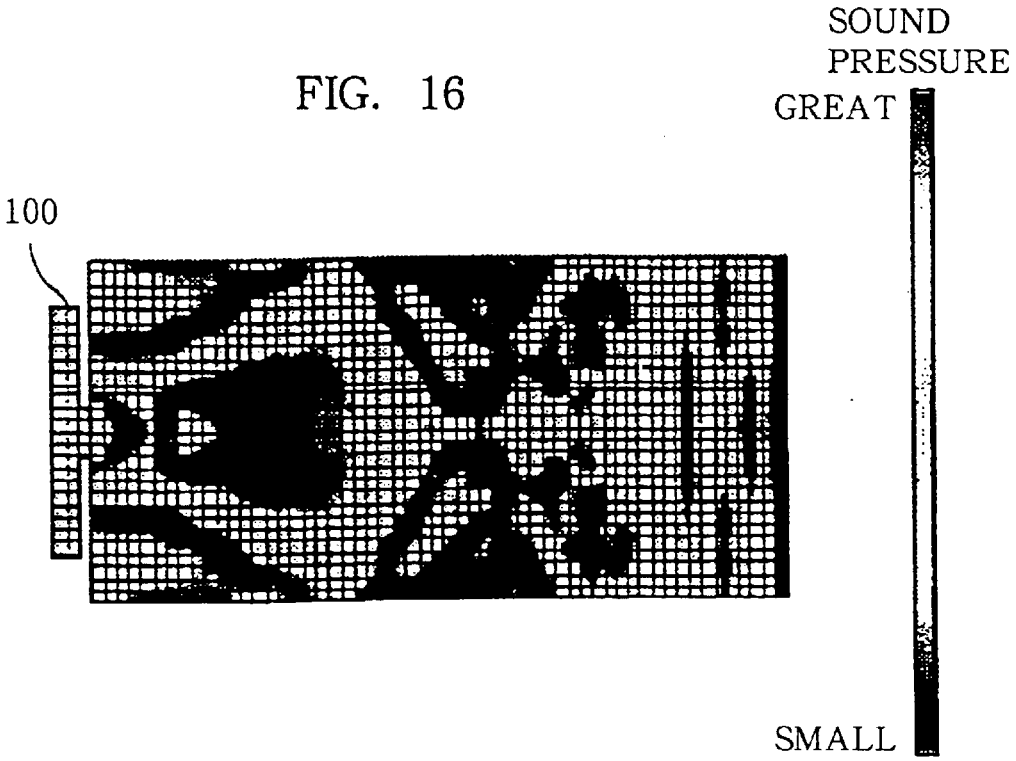
FIG. 16 is a view showing still another example of energy distribution derived by the sound motion simulation for determining sound scattering characteristics of the sound radiating structure.

Sound radiating structure where each of the pipes has the side opening 13*a* formed at a position corresponding to one half of the pipe length L (½ L) as measured from the closure 12 (see FIG. 16).

(Case 3-B)

Figure 17:
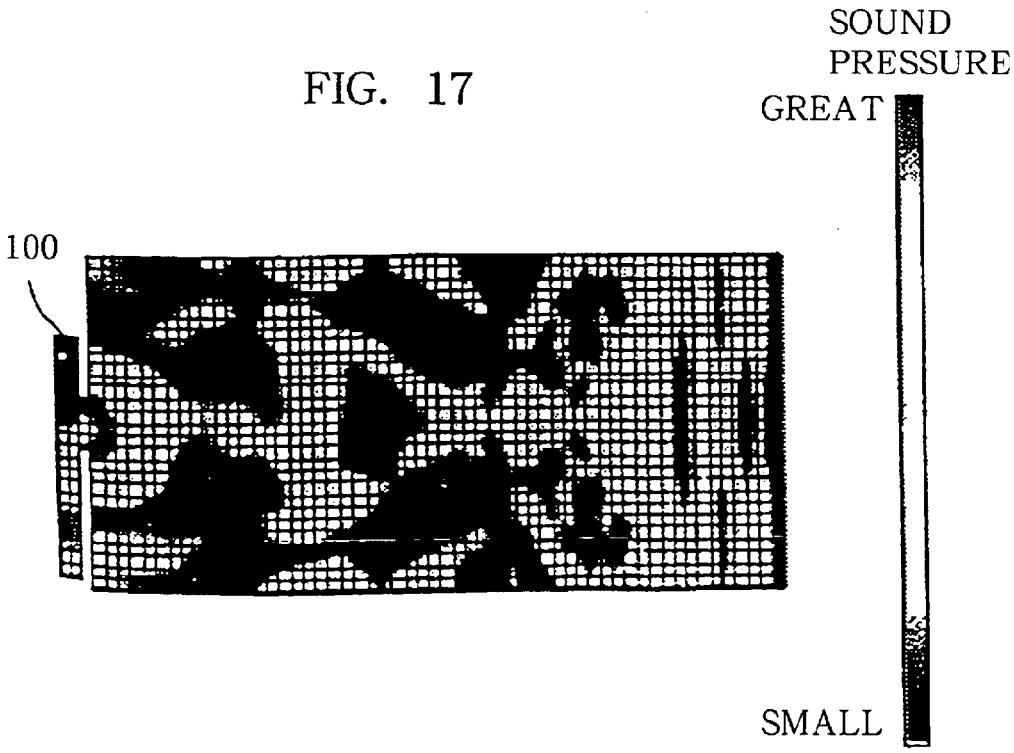
FIG. 17 is a view showing still another example of energy distribution derived by the sound motion simulation for determining sound scattering characteristics of the sound radiating structure.

Sound radiating structure where each of the pipes has the side opening 13*a* formed at a position corresponding to one-third of the pipe length L (⅓ L) as measured from the closure 12 (see FIG. 17).

(Case 3-C)

Figure 18:
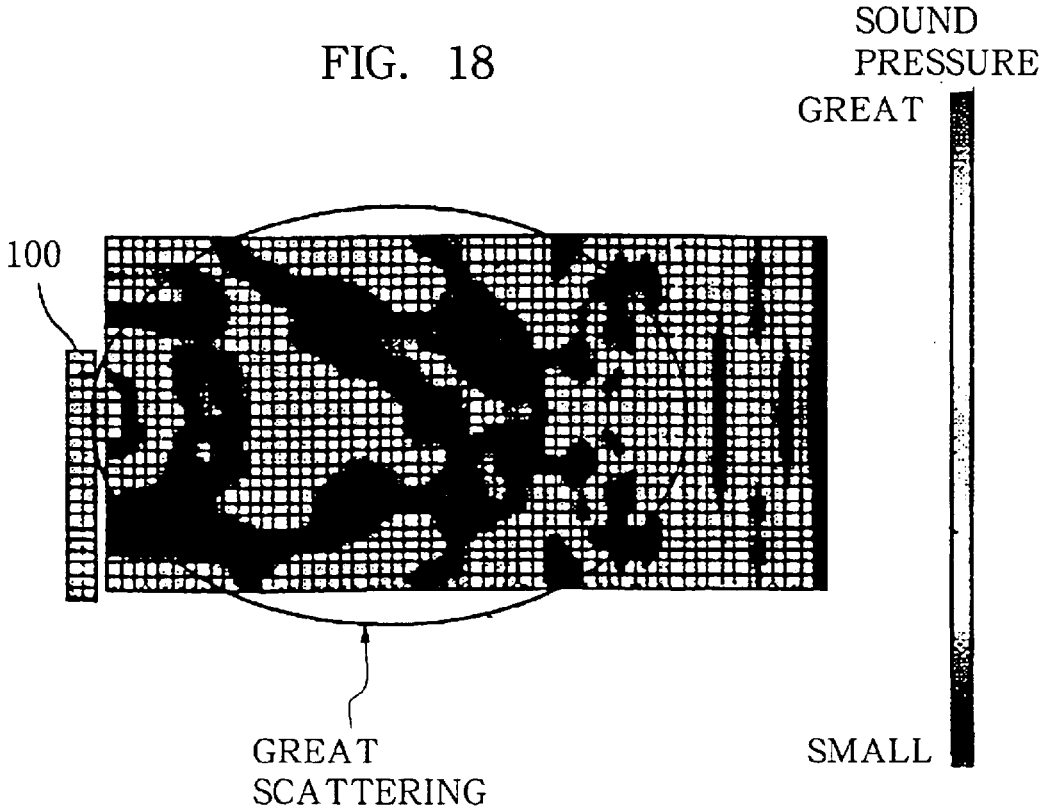
FIG. 18 is a view showing still another example of energy distribution derived by the sound motion simulation for determining sound scattering characteristics of the sound radiating structure.

Sound radiating structure where each of the pipes has the side opening 13*a* formed at a position corresponding to one quarter of the pipe length L (¼ L) as measured from the closure 12 (see FIG. 18).

(Case 3-D)

Figure 19:
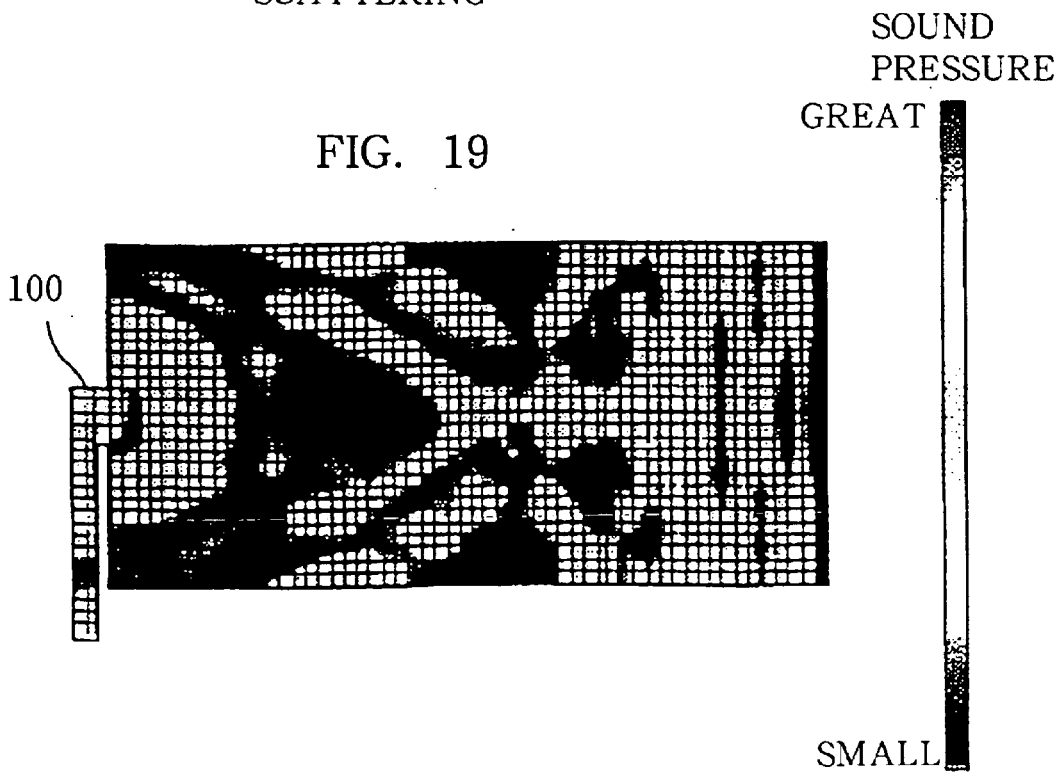
FIG. 19 is a view showing still another example of energy distribution derived by the sound motion simulation for determining sound scattering characteristics of the sound radiating structure.

Sound radiating structure where each of the pipes has the side opening 13*a* formed near the closure 12 (see FIG. 19).

As regards the wall thickness of the pipe where is formed the end opening 11 (Case 1), it can been seen from comparison between the examples of FIGS. 12 and 13 that the sound radiating structure with the pipes having smaller wall thicknesses produce greater re-radiated sound energy and that the radiated sound waves are greatly disturbed, i.e. the sound energy is scattered (small differences occur between shades of color) in regions remote from the sound radiating structure 100 to the right of the structure 100.

As regards the curved surface (Case 2), it can been seen from comparison between the examples of FIGS. 14 and 15 that the sound radiating structure where each of the pipes has the inward curved surface formed on the edge defining the side opening 13*a* produces greater disturbances in rear wavefronts as shown in FIG. 14 and the sound radiating structure where each of the pipes has the outward curved surface formed on the edge slightly disturbs the fore end of travelling waves as shown in FIG. 15.

Further, as regards the position of the side opening 13*a* (Case 3), it can been seen from comparison among the examples of FIGS. 16 to 19 that the sound radiating structure, where each of the pipes has the side opening 13*a* formed off the piddle of the pipe toward one of the opposite ends, produces greater sound wave disturbances (greater differences between shades in the figure), as shown in FIGS. 17 and 18, and thus better sound scattering characteristics than the sound radiating structure where each of the pipes has the side opening 13*a* formed in the middle of the pipe length L (see FIG. 16). Particularly, as shown in FIG. 18, the sound radiating structure where each of the pipes has the side opening 13*a* formed at the position corresponding to one quarter of the pipe length L (¼ L) produces the greatest sound wave disturbances and presents the best sound scattering characteristics.

From the above-mentioned results of the wave motion simulation, it can be understood that better sound scattering characteristics can be presented by the sound radiating structure 100 of the invention where each of the pipes has as small a wall thickness as possible and has the side opening 13*a* formed at the position corresponding to one quarter of the pipe length L (¼ L) as measured from the closure 12.

Figure 20:
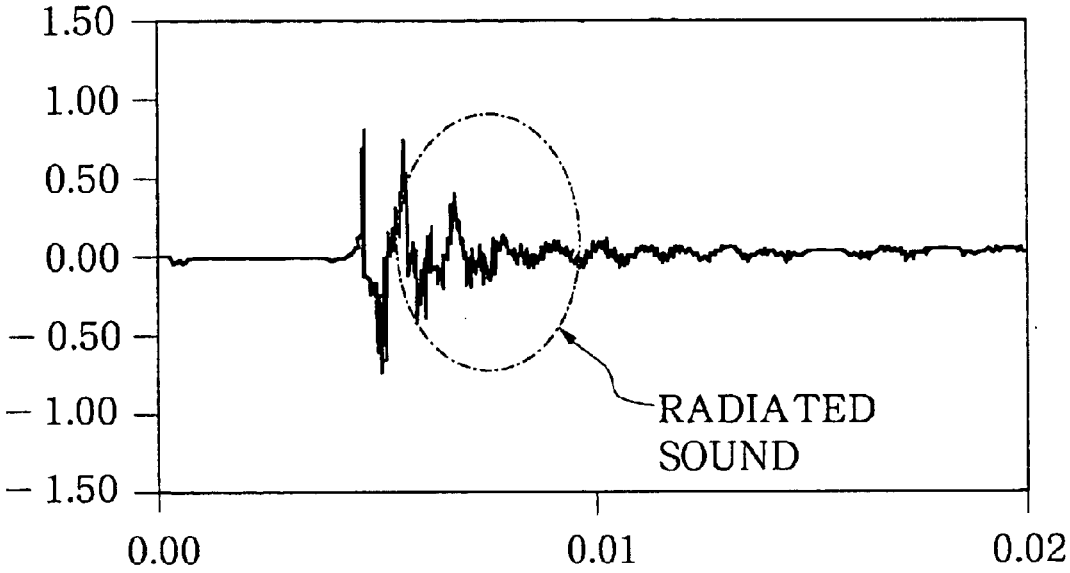
FIG. 20 is a graph showing a time waveform of an impulse response measured when the sound radiating structure is installed on a given boundary surface of the acoustic room.
Figure 21:
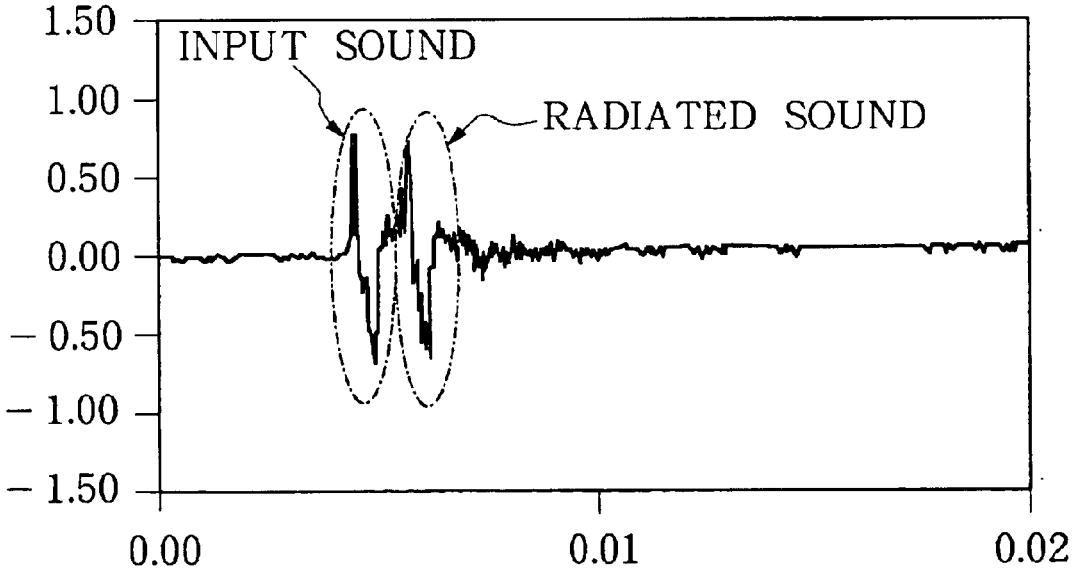
FIG. 21 is a graph showing a time waveform of an impulse response measured when the sound radiating structure is not installed in the acoustic room.
Figure 22:
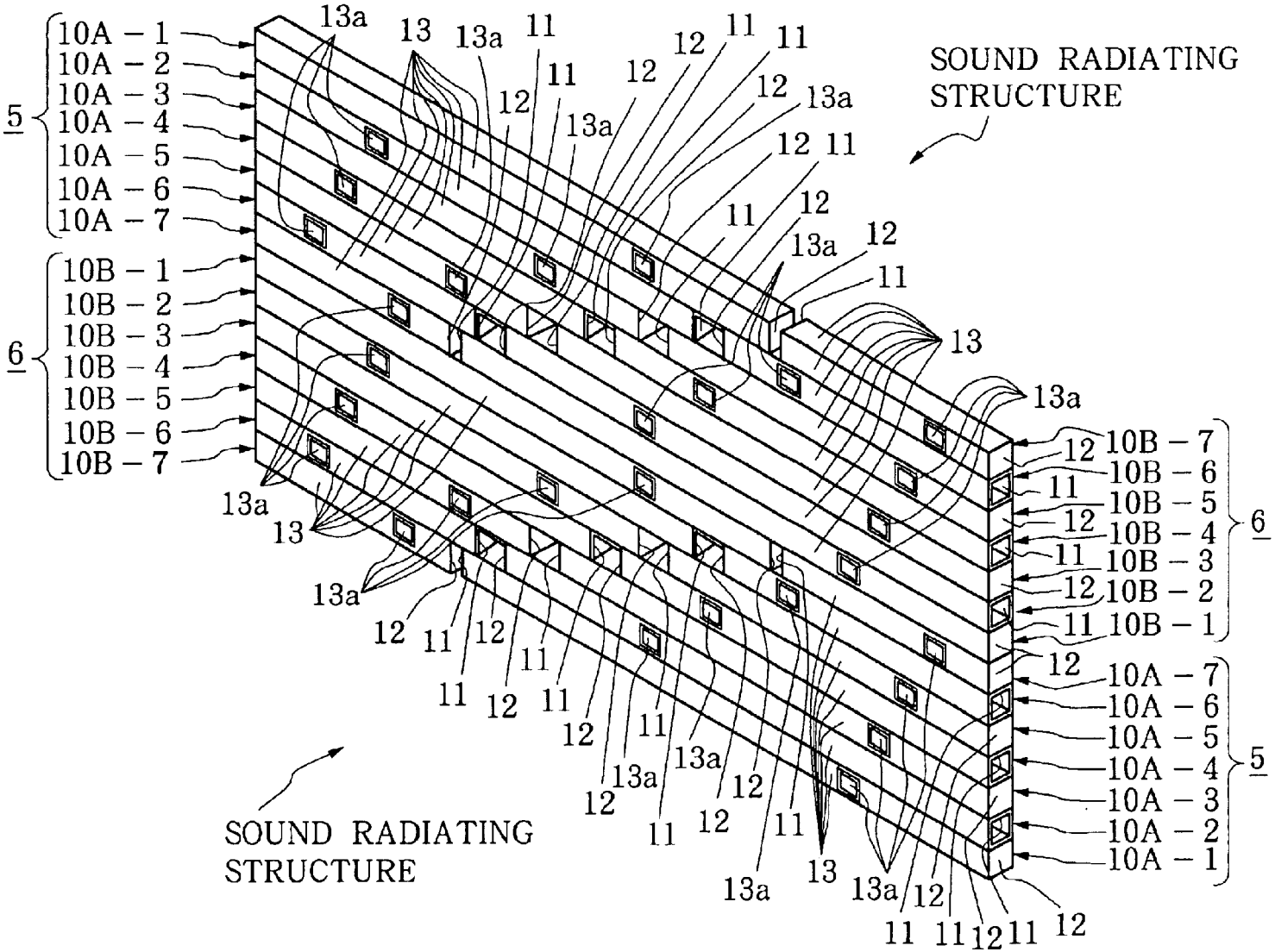
FIG. 22 is a perspective view showing an outer appearance of the sound radiating structure for which the time waveform of the impulse response was measured.

Next, in order to evaluate advantageous effects by the sound scattering function of the sound radiating structure 100 of the invention from the viewpoint of interference between direct sounds and reflected sounds, measurement is made of impulse responses in the case where the sound radiating structure 100 of the invention was installed on the floor of the acoustic room and in the case where the sound radiating structure 100 was not installed on the floor of the acoustic room. FIGS. 20 and 21 show results of the impulse response measurement. Experiment to be described below was conducted using a sound radiating structure that comprises a pair of the combined-type sound radiating structure 100 made up of the first and second sound radiating structures 5 and 6, as shown in FIG. 22.

Figure 23:
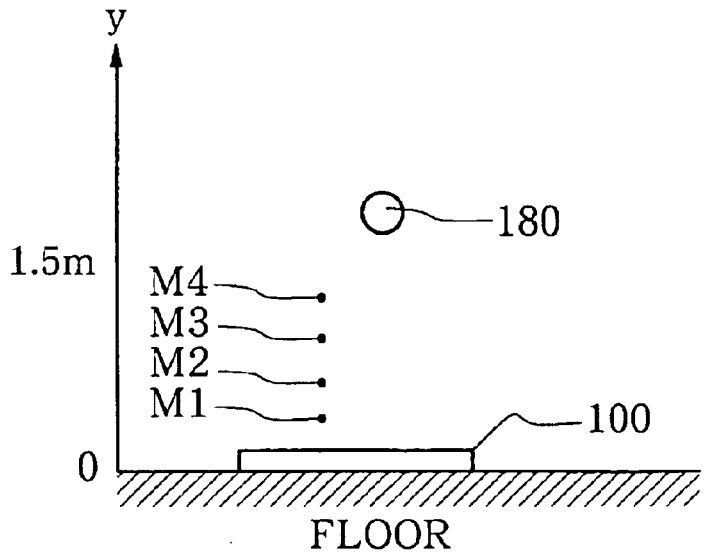
FIG. 23 is a view explanatory of experiment conditions for measuring the time waveform of the impulse response.

First, conditions under which the impulse response measurement was made are set forth with reference to FIG. 23. As shown in the figure, the sound radiating structure was installed on the floor at a position where the Y coordinate value was zero, and a nondirectional speaker (combined type) 180 functioning as a sound source was installed at a position where the Y coordinate value was 1.5 (m); note that if no sound radiating structure 100 is installed, then the Y coordinate is always zero coinciding with the floor level. Then, a plurality of microphones were installed at positions where the Y coordinate values were 0.25 (m) (M1 point), 0.5 (m) (M2 point), 0.75 (m) (M3 point) and 1.0 (m) (M4 point). At each of the above-mentioned positions, a sound was picked up by the corresponding microphone so as to measure the impulse response. Because impulse response waveforms obtained through the measurement at the individual positions present similar tendencies, only the measured results of the M1 point are shown in FIG. 20 (in relation to the case where the inventive sound radiating structure was installed on the floor) and in FIG. 21 (in relation to the case where the inventive sound radiating structure was not installed on the floor).

In the case where the sound radiating structure 100 of the invention was not installed, a reflected sound wave from the floor surface occurs, in an isolated state, following an input sound wave, as shown in FIG. 21. By contrast, in the case where the sound radiating structure 100 was installed, a radiated sound occurs additionally following a reflected sound and the radiated sound is not isolated, as shown in FIG. 20. Thus, by installing the sound radiating structure of the present invention, it is possible to minimize acoustic obstacles, such as flutter echo that would be produced by only reflected sounds becoming prominent.

Then, in order to verify that the undesired flutter echo can be minimized by the sound radiating structure 100 of the invention, further experiments were conducted under the following conditions, to derive, from the results of the sound reception by the microphones, time waveforms of the impulse responses, waveforms of frequency characteristics, spectrograms representing energy of STFT (Short Time Fourier Transformation)-processed waveforms, and frequency-by-frequency standard deviations of the spectrograms. The STFT is a process for extracting a signal per short time period $\Delta t$ and performing the Fourier transformation on the extracted signal for each short time period $\Delta t$. Because frequency characteristics of a non-standing wave signal, such as a sound wave signal to be currently measured, vary with time, the sound wave signal to be currently measured has to be expressed by a function of the time and frequency. This is why the inventors decided to verify the sound scattering effects of the sound radiating structure 100 of the invention by deriving the spectrograms of the STFT-processed waveforms when the sound radiating structure 100 was installed in the acoustic room and when the sound radiating structure 100 was not installed in the acoustic room and then comparing the thus-derived spectrograms of the STFT-processed waveforms.

Figure 24:
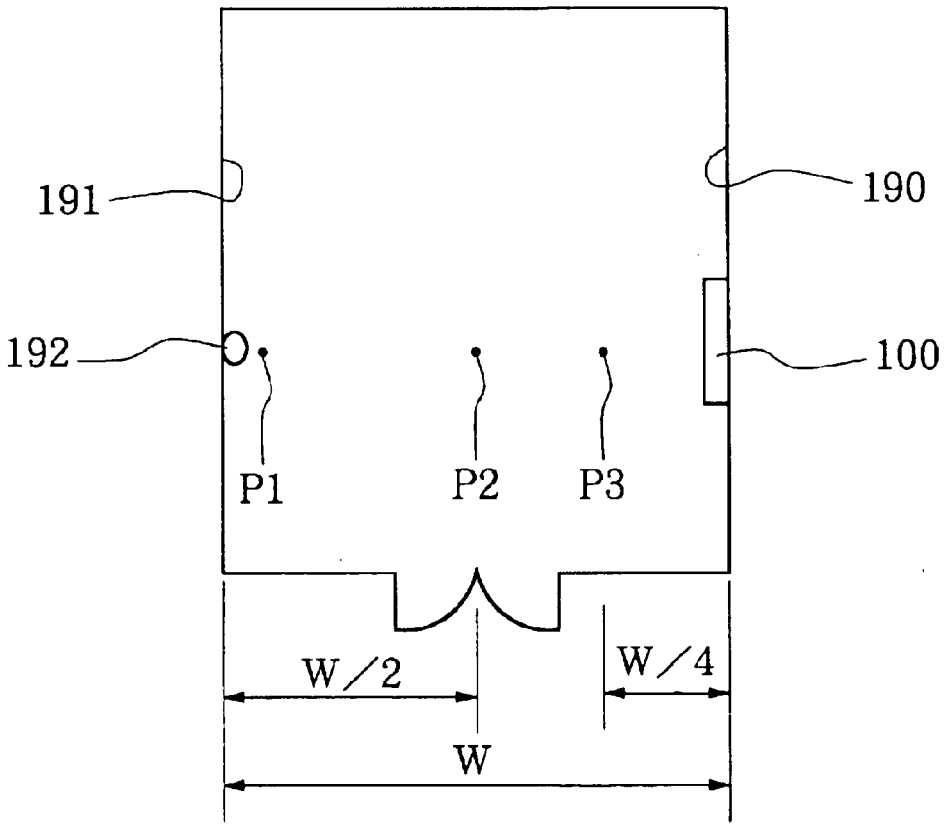
FIG. 24 is a view explanatory of experiment conditions for verifying that the sound radiating structure of the invention can minimize acoustic obstacles.

First, conditions under which the experiments were conducted are set forth with reference to FIG. 24. FIG. 24 is a plan view of an experimental room generally in the shape of a rectangular parallelepiped. Specifically, comparative experiments were conducted for the case where the sound radiating structure of the invention was installed on one of wall surfaces 190 (right wall surface in the illustrated example) and another case where the sound radiating structure of the invention was not installed at all, i.e. where only the wall surfaces were present. Here, a speaker 192, functioning as a sound source, was attached to another wall surface 191, parallel opposed to the above-mentioned wall surface 190 where the sound radiating structure 100 was installed, at a height of 1.4 m above the floor. A plurality of microphones were installed at a first position (P1 point) proximate to the wall surface 191 where the speaker was installed, at a second position (P2 point) exactly halfway between the parallel opposed wall surfaces 190 and 191, namely, a position corresponding to one half of the width W of the room (½ W) as measured from the speaker 192, and at a third position (P3 point) corresponding to three quarters of the width W (¾ W) as measured from the sound source. Note that all the microphones were positioned at a 1.4 m level above the floor. Sounds were received and measured at the individual positions (P1 to P3 points) for each of the cases where the sound radiating structure of the invention was installed and where the sound radiating structure of the invention was not installed, and then there were obtained results as shown in FIGS. 25 to 30. Specifically, FIGS. 25 to 30 show various waveforms derived only from the results of the sound measurement through the microphone installed at the P2 point. Because waveforms derived from the results of the sound measurement through the microphones installed at the P1 and P3 points presented tendencies similar to the waveforms derived for the P2 point, only the waveforms derived for the P2 point are representatively shown in the figures, and advantageous effects of the sound radiating structure 100 of the invention will be set forth only in relation to the waveforms derived for the P2 point. Also note that FIGS. 25 to 30 were prepared by monochromatically printing, on sheets of paper, computer graphics indicating the results of the simulation which normally should be displayed as colored images on a computer display device. Because such figures can not reproduce details of the waveforms, some supplemental remarks are added to the figures about characteristic portions of the waveforms as necessary for the explanation.

Figure 25:
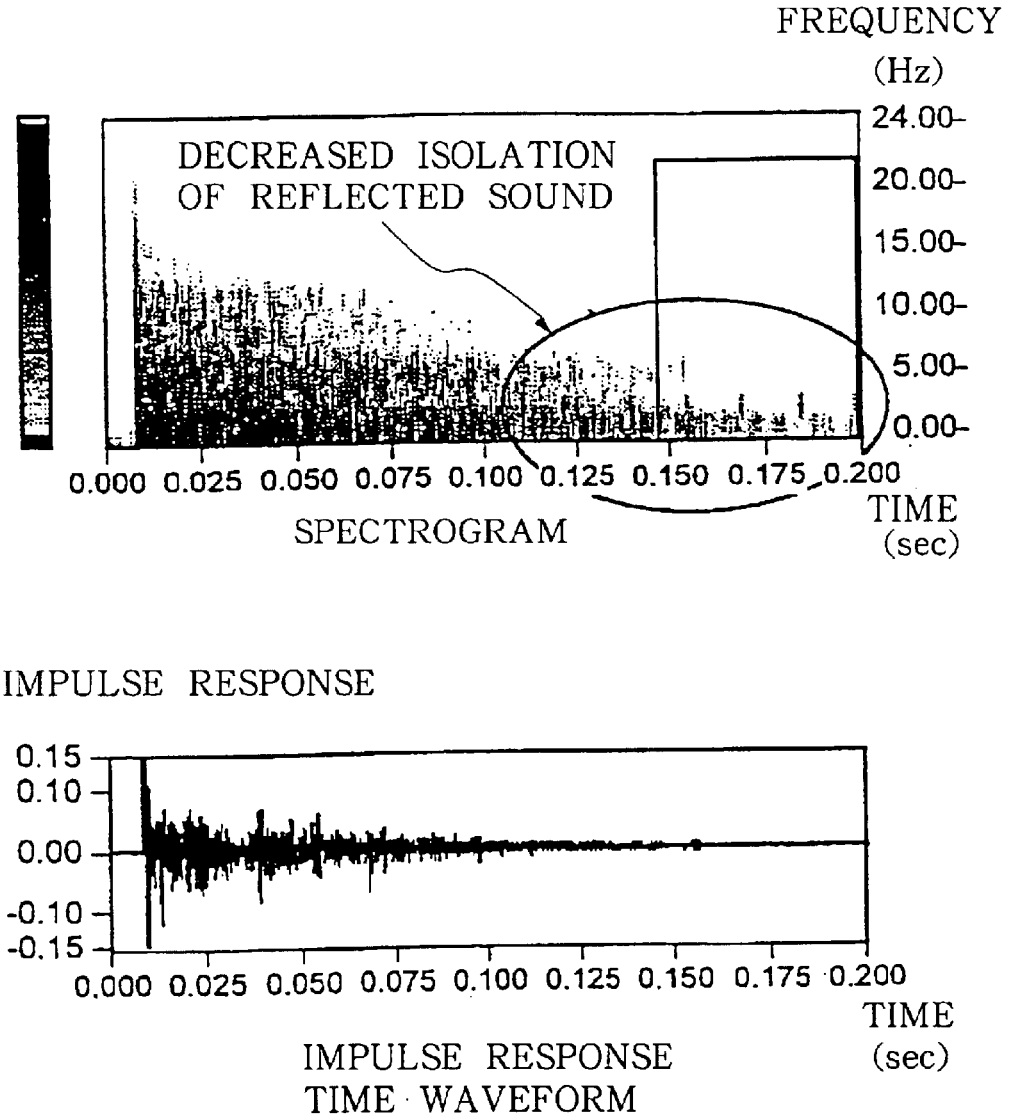
FIG. 25 is a diagram showing a spectrogram of an STFT waveform and a time waveform of an impulse response derived when the sound radiating structure of the invention was installed on a boundary surface of an acoustic room.
Figure 26:
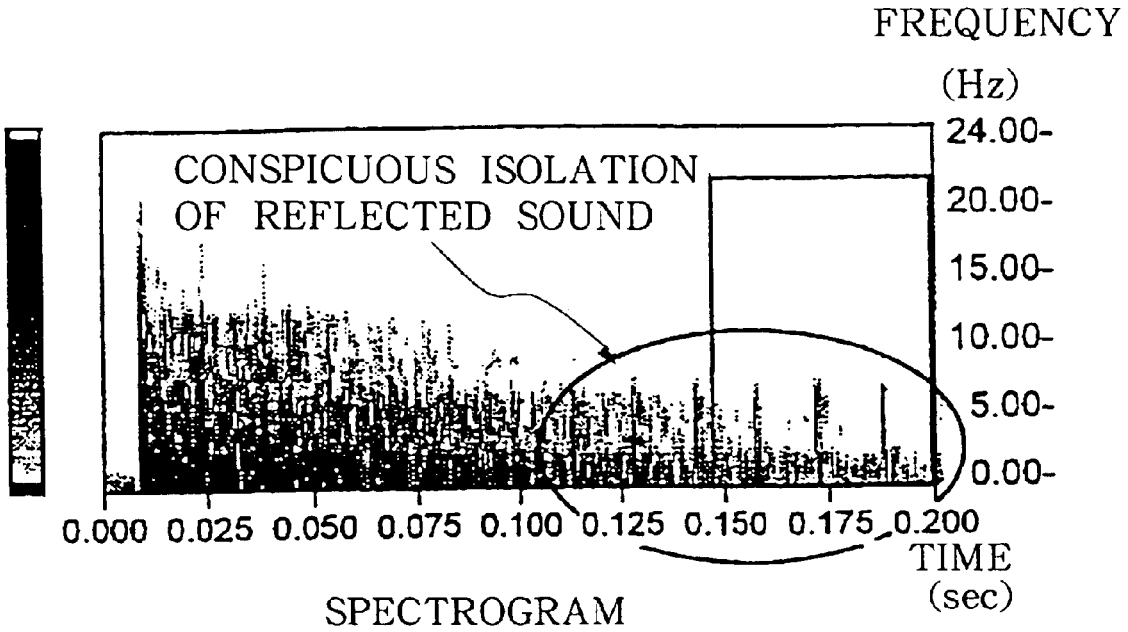
FIG. 26 is a diagram showing a spectrogram of an STFT waveform and a time waveform of an impulse response derived when the sound radiating structure of the invention was not installed.
Figure 26:
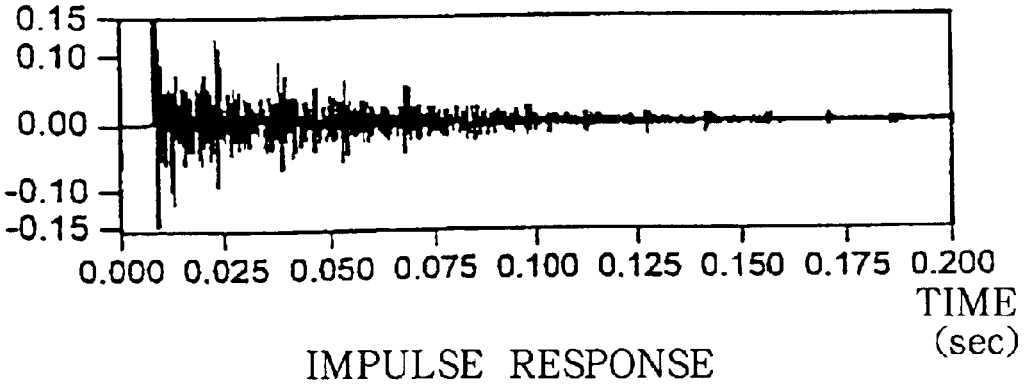

FIG. 25 shows a spectrogram of an STFT waveform derived on the basis of the results of the sound measurement through the microphone installed at the P2 point (upper section of the figure) and a time waveform of an impulse response (lower section of the figure) in the case where the sound radiating structure of the invention was installed. FIG. 26 shows a spectrogram of an STFT waveform derived on the basis of the results of the sound measurement through the microphone installed at the P2 point (upper section of the figure) and a time waveform of an impulse response (lower section of the figure) in the case where the sound radiating structure of the invention was not installed.

Comparison between the impulse response time waveforms shown in FIGS. 25 and 26, it can be seen that a multiplicity of reflected sounds were present in an isolated state in the case of FIG. 26 where the sound radiating structure of the invention was not installed. In the case of FIG. 25 where the sound radiating structure of the invention was installed, on the other hand, the reflected sounds were made less prominent or subdued by radiated sounds from the radiating structure. Further, it is apparent that reflected sound waves were shown as isolated in the STFT waveform spectrogram of FIG. 26. By contrast, such reflected sound waves were made less prominent or subdued in the waveform derived in the case where the sound radiating structure was installed. Thus, it is apparent that the sound radiating structure of the present invention can effectively prevent the reflected sounds from causing acoustic obstacles such as flutter echo.

Figure 27:
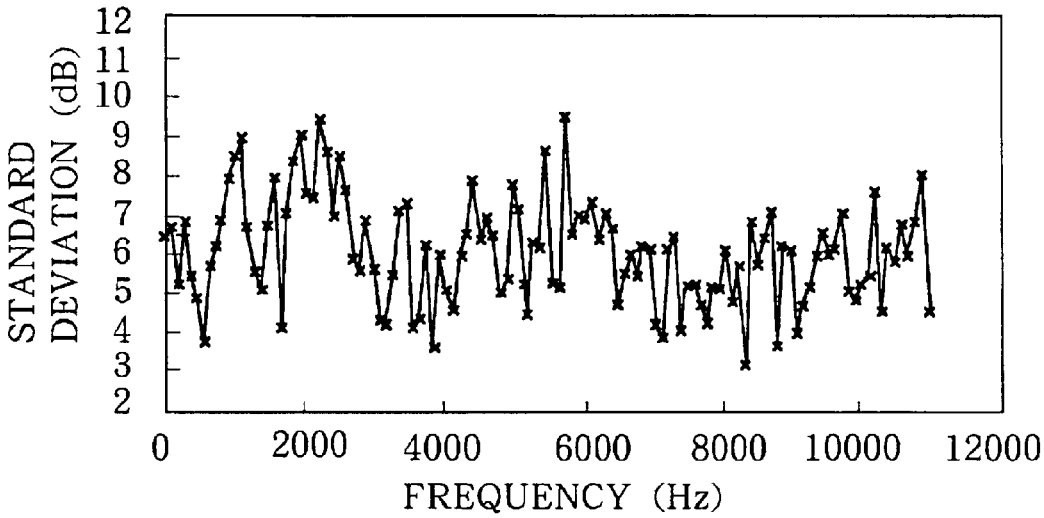
FIG. 27 is a graph showing frequency-by-frequency standard deviations of the spectrogram derived when the sound radiating structure of the invention was installed on the boundary surface.
Figure 28:
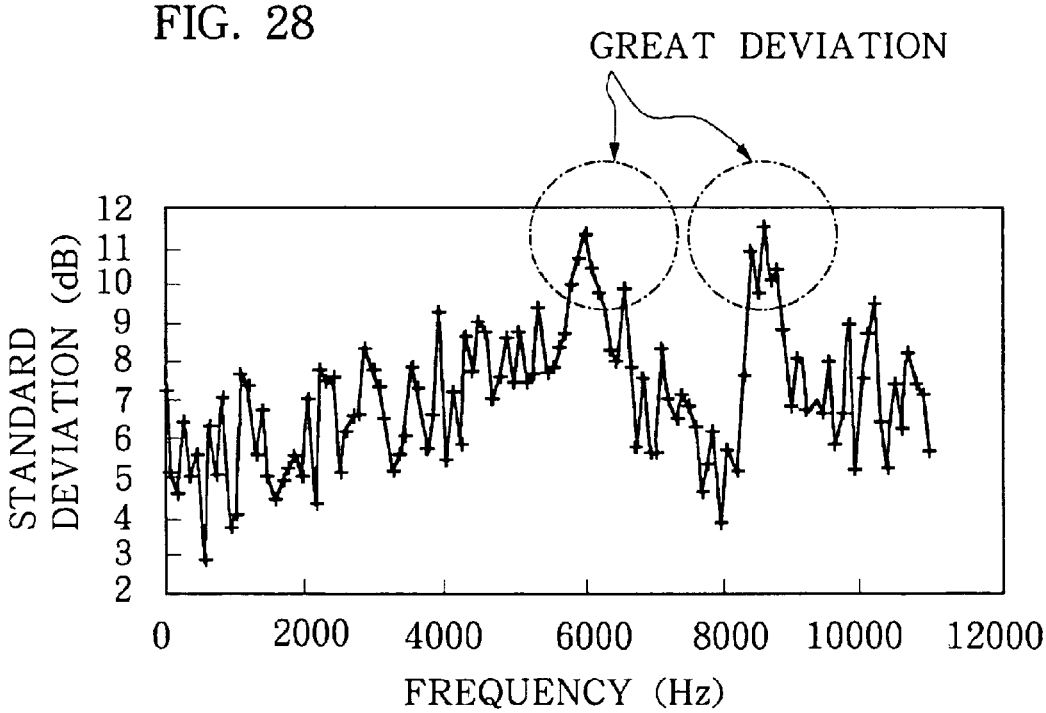
FIG. 28 is a graph showing frequency-by-frequency standard deviations of the spectrogram derived when the sound radiating structure of the invention was not installed.

From comparison between the spectrograms of FIGS. 25 and 26, it can be seen that the provision of the sound radiating structure of the present invention could reduce deviations in a 0.15–0.20 msec. region (shown in the figures as enclosed by a thick-line) of the spectrogram. The waveforms as shown in FIGS. 27 and 28 are obtained by calculating frequency-by-frequency standard deviations in the 0.15–0.20 msec. region. Comparison between the waveforms of FIGS. 27 and 28 can show that the deviations were great, as depicted in circles, in the case where the sound radiating structure of the invention was not installed (FIG. 28) and that the deviations were reduced by the provision of the sound radiating structure of the invention (FIG. 27). This means that the provision of the sound radiating structure of the invention can effectively prevent the reflected sound energy from being undesirably isolated.

Figure 29:
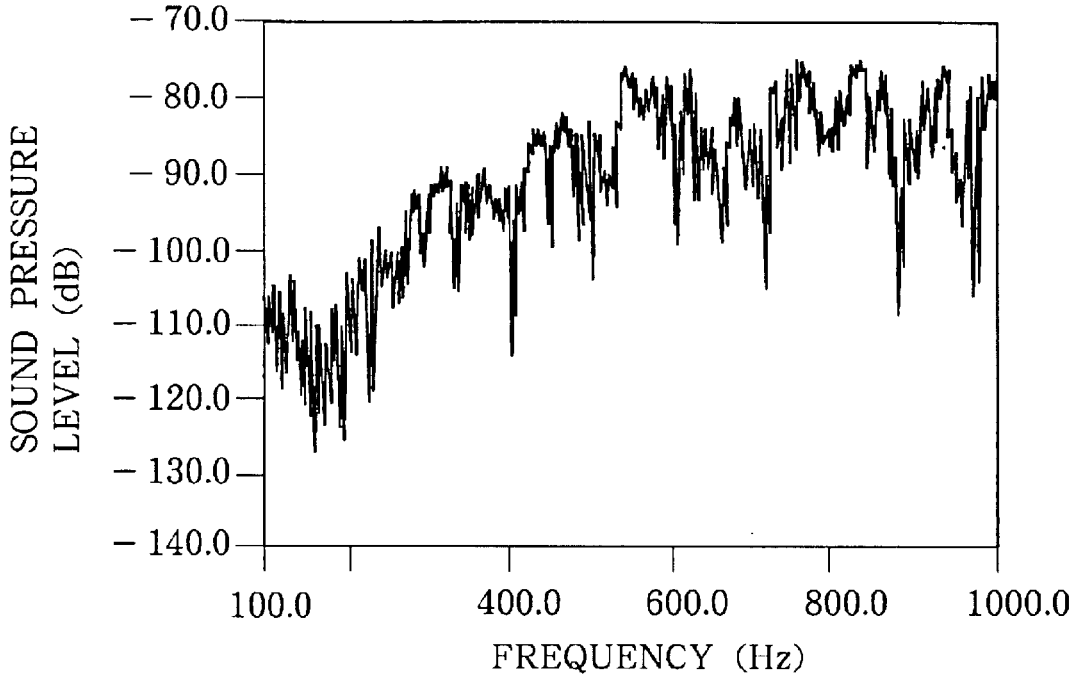
FIG. 29 is a graph showing frequency characteristic derived when the sound radiating structure of the invention was installed on the boundary surface.
Figure 30:
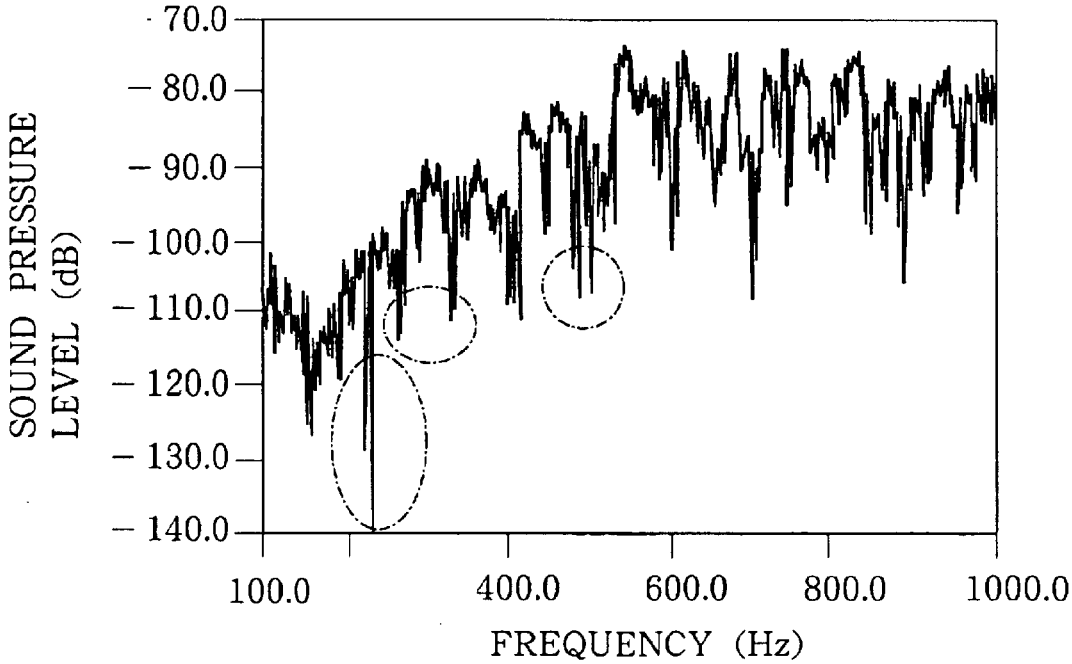
FIG. 30 is a graph showing frequency characteristic derived when the sound radiating structure of the invention was not installed.

FIGS. 29 and 30 show frequency characteristic waveforms derived on the basis of the sound measurement through the microphone; more specifically, FIG. 29 shows the frequency characteristic waveform in the case where the sound radiating structure of the invention was installed, while FIG. 30 shows the frequency characteristic waveform in the case where the sound radiating structure of the invention was not installed. Looking at dips in the waveforms shown in these figures, the waveform in the case of FIG. 30, where the sound radiating structure of the invention was not installed, contained many dips, but such dips were reduced and the waveform considerably leveled off in the case of FIG. 29 where the sound radiating structure of the invention was installed.

The various measurement and experiments described above confirmed that the sound radiating structure 100 of the invention, by re-radiating sound waves of various frequencies, achieves superior sound scattering characteristics and can effectively prevent the undesired isolation of reflected sounds to thereby minimize acoustic obstacles such as flutter echo.

Further, as confirmed through the various experiments, the sound radiating structure 100 of the invention achieves superior sound scattering characteristics even where the cross-sectional size of each of the pipes is only in the order of 60 mm×60 mm. Consequently, the sound radiating structure 100 of the invention can be formed into a reduced thickness as compared to the conventional sound radiating structures with mountain-shaped or semicircular sound scattering members and Shroeder sound scattering structure.

In addition, whereas the conventional sound radiating structures with the mountain-shaped or semicircular sound scattering members and Shroeder sound scattering structure have big projections and depressions on their surfaces and thus would lead to a special outer appearance of an acoustic room where the radiating structure is installed and would greatly influence the design of the entire room, the sound radiating structure 100 of the invention has a substantially flat outer surface constituted by the respective flat side portions 13 of the pipes and is installed in a desired room so that the substantially flat outer surface faces the interior of the room. Because the substantially flat outer surface is similar in appearance to a normal wall surface, the inventive sound radiating structure can assure the same flexibility in designing the entire room as in the case where no such sound radiating structure is installed at all. Further, because the overall configuration of the sound radiating structure 100 of the invention is just like a flat plate having generally flat outer surfaces, the inventive radiating structure 100 can be properly installed snugly in any desired place and installation of the radiating structure does not necessitate designing of the room into a special shape.

E. Modifications

The present invention should never be construed as limited only to the above-described embodiments, and various modifications of the invention are also possible as stated hereinbelow.

(Modification 1)

Whereas the pipes constituting the sound radiating structures 5 and 6 have each been described as being of a tubular shape having a generally square cross section, it may be of any other suitable shape; for example, each of the pipes may be a cylindrical pipe having a circular cross section or may be of a tubular shape having a rectangular cross section. In another alternative, each of the pipes may have be formed so that it has a tubular outer shape with a rectangular cross section but the inner cavity defined thereby has a circular cross section.

(Modification 2)

Further, although the measurement and experiments have been described as using the pipes each having the cross-sectional size of 60 mm×60 mm, any other suitable size of the pipes may be chosen depending on designing conditions etc. Considering that the sound radiating structure of the invention is attached to a wall surface or ceiling surface of an acoustic room, it is preferable that the thickness of the sound radiating structure be as small as possible, in order to prevent the effective interior space of the room from being reduced or narrowed by the provision of the radiating structure. If the cross-sectional size of the pipes is too small, it is likely that the radiating structure can not obtain sufficient incoming sound energy for sound re-radiation purposes and thus fails to yield good sound scattering effects. However, the above-described various experiments shown that the 60 mm×60 mm cross-sectional size of the pipes can attain sufficient sound scattering effects. If both the sound scattering effects and the space use efficiency are taken into consideration, it can be said that the suitable cross-sectional size of the pipes is about 60 mm×60 mm. The lengths L of the individual pipes are also not limited to the above-mentioned (see FIG. 9) and may be decided arbitrarily depending on the frequency bands of sounds to be scattered.

(Modification 3)

Furthermore, whereas each of the pipes in the embodiments has been described as having the end opening 11 at its one end and being closed at the other end with the closure 12, the pipe may be open at the opposite ends. However, the pipe opening at the two ends would produce a resonant frequency twice as high as that provided by the closed pipe. Therefore, although such a pipe opening at the two ends may be used appropriately (i.e., without significant problems) as a high-frequency sound radiating structure intended for attaining good sound scattering characteristics in high frequency bands, it will not work properly for scattering sounds in low frequency bands. Therefore, it is preferable that each of the pipes be closed at its one end with the closure 12 in a situation where the sound radiating structure is designed for attaining good sound scattering characteristics in low frequency bands.

Further, each of the pipes in the inventive sound radiating structure may be open at the opposite ends and provided with detachable closures 12 at the open ends in such a manner that the sound radiating structure can be adjustably shifted between a high frequency mode for processing sounds of high frequency bands and a low frequency mode for processing sounds of low frequency bands. In this case, it is possible to allow any one of the pipes to function as an open pipe or a closed pipe by selectively shifting the corresponding closure 12 between an opening position and a closing position. Thus, it is possible to readily adjust the frequency range where the inventive sound radiating structure can provide good sound scattering characteristics.

(Modification 4)

Further, the side opening 13*a* in the side portion 13 of each of the pipes may be formed at any other suitable position of the side portion 13 than the above-mentioned position corresponding to one quarter of the pipe length L (¼ L) as measured from the closed end with the closure 12. However, it is preferable that the side opening 13*a* be formed at such a ¼ L position because the inventive sound radiating structure can present good sound scattering characteristics with the side opening 13*a* formed at the ¼ L position in each of the pipes, as apparently indicated by the above-described experiment results.

Furthermore, whereas the embodiments have been described above in relation to the case where the side opening 13*a* is formed in the side portion 13 that faces the central area of an acoustic room when the inventive sound radiating structure is installed in place, such a side opening 13*a* may be formed in any one of the other side portions of the pipe except for the rear side portion contacting the wall surface of the acoustic room. However, since the sound radiating structure is intended for attaining good sound scattering characteristics indoors, it is preferable that side opening 13*a* be formed in the side portion 13 facing the central area of the acoustic room.

Further, a plurality of the side openings 13*a* may be formed in the side portion 13 if each of the pipes and a detachable closure may be provided for each of the side openings 13*a* in such a manner that the opened/closed state of each of the side openings 13*a* can be selected depending on the designing conditions such as frequency bands of sounds to be scattered by the inventive sound scattering structure.

(Modification 5)

Further, the embodiments of the invention have been described above in relation to the sound radiating structures 5 and 6 each including seven pipes and the combined-type sound radiating structure comprising the combination of such sound radiating structures 5 and 6. However, the present invention is not limited to the described embodiments, and the number of the pipes employed in the radiating structure is not limited to the above-described. Further, in the combined-type sound radiating structure, the sound radiating structures 5 and 6 may be arranged and combined in any other manner than being arranged and combined as two completely separated structures, and the construction and number of the pipes, manner in which the pipes are combined, etc. are not limited to the above-described and may be chosen arbitrarily.

(Modification 6)

The embodiments of the present invention have been described above in relation to the case where the pipes of the sound radiating structure 100 are oriented so that their end openings 11 and closures 12 alternate. In an alternative, however, the pipes of the sound radiating structure 100 may be disposed in another orientation where the end openings 11 of all the pipes are located at one end of the radiating structure while the closures 12 of all the pipes are located at the other end of the radiating structure. But, orientating the pipes of the sound radiating structure 100 so that their end openings 11 and closures 12 alternate as in the described embodiments is preferable in that a multiplicity of the openings, through which sounds are to be re-radiated, are scattered to effectively promote the sound scattering capability. If the openings are located too close to each other, then it is likely that sounds are excessively absorbed as in the Shroeder sound scattering structure. Thus, unless there is a particular reason to the contrary, it is preferable to position the pipes in the orientation where their end openings 11 and closures 12 alternate, as in the above-described embodiments.

(Modification 7)

Figure 31:
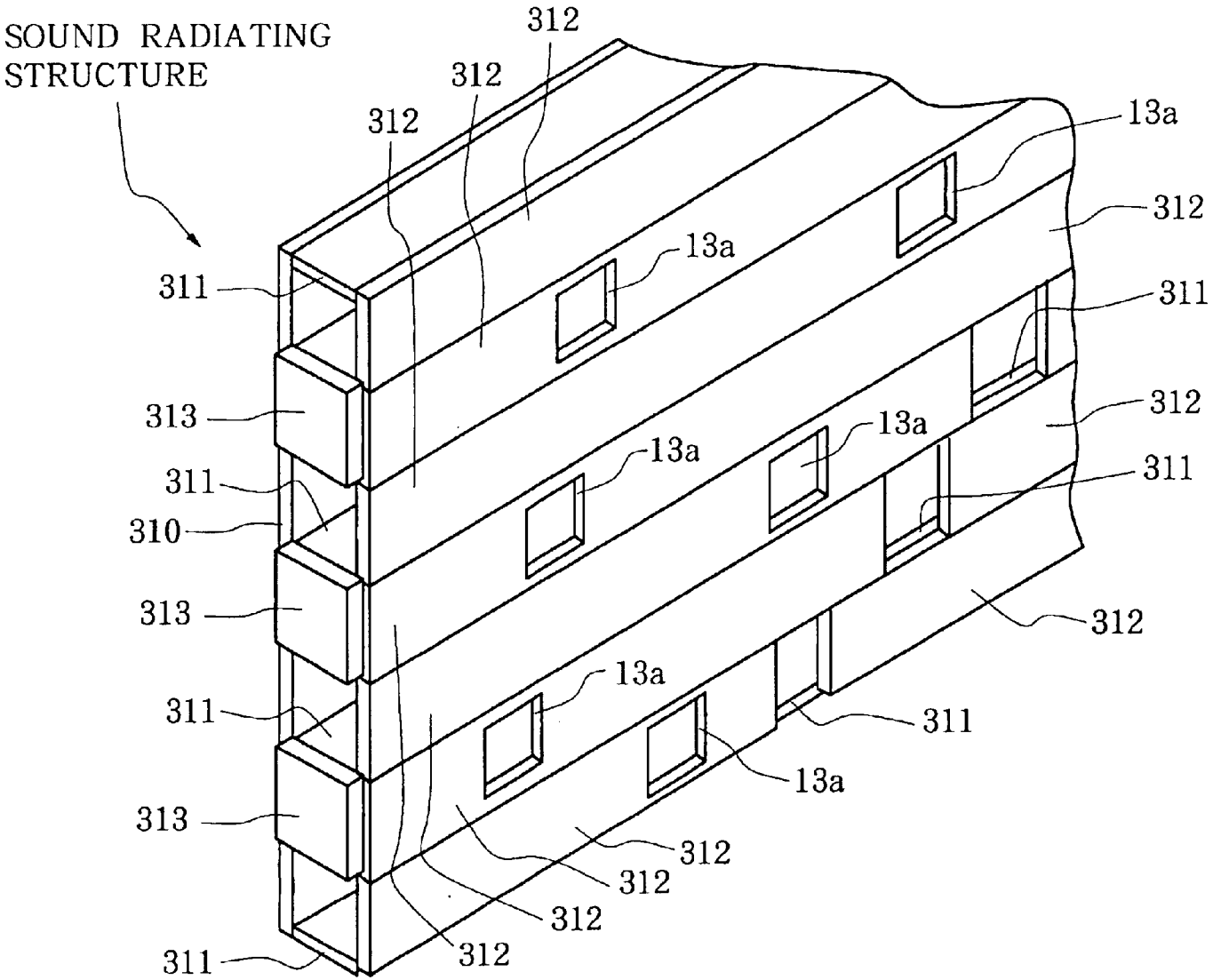
FIG. 31 is a perspective view showing a modification of the sound radiating structure of the invention.

Furthermore, the embodiments have been described as constituting the sound radiating structure by arranging a plurality of pipes each having an inner cavity of a square cross-sectional shape. As shown in FIG. 31, a modified sound radiating structure 315 may be constructed which provides such inner cavities using back plates 310, partition plates 311, front plates 312 and closure plates 313. As shown in the figure, this modification constitutes a structure generally similar to the above-described sound radiating structures 5 and 6 and combined-type sound radiating structure 100 which are composed of a plurality of pipes, by appropriately combining the back plates 310, partition plates 311, front plates 312 and closure plates 313.

Figure 32:
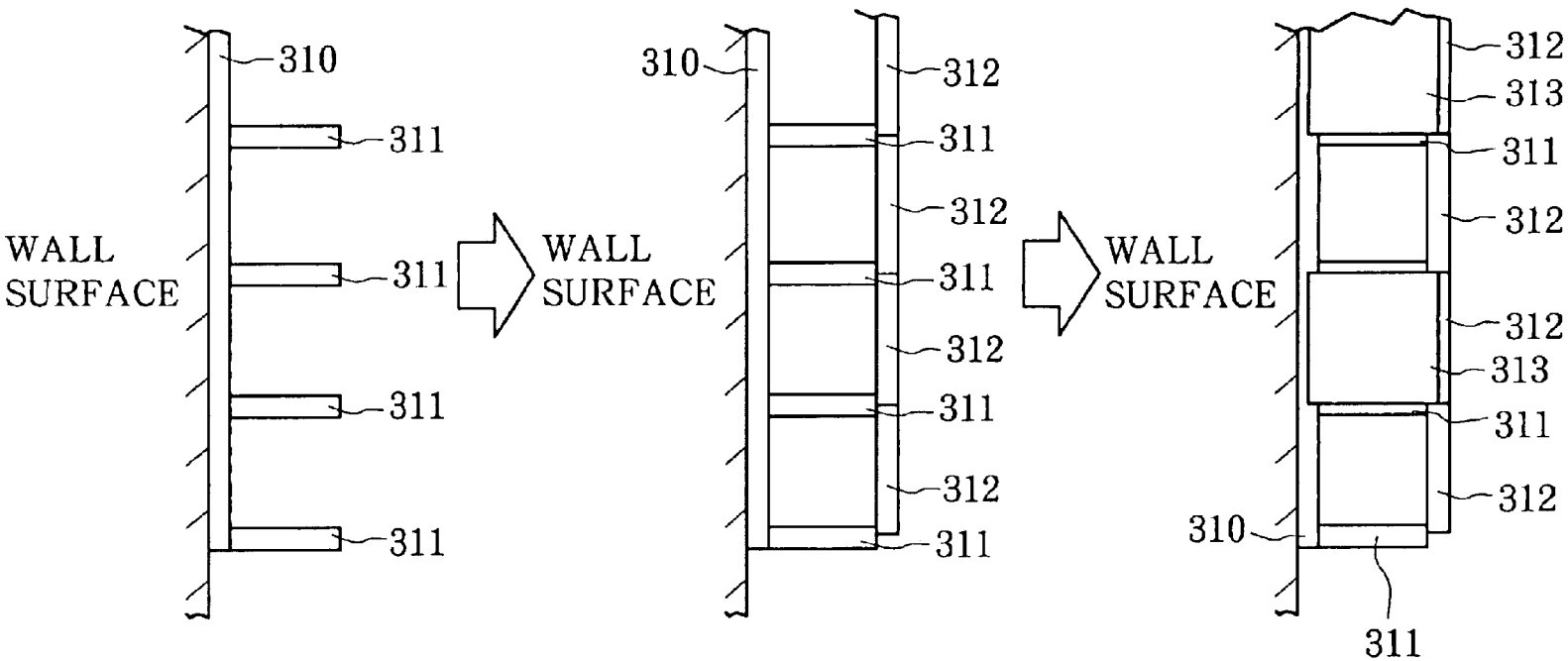
FIG. 32 is a view explanatory of how the modified sound radiating structure of FIG. 31 is assembled.

More specifically, as shown in FIG. 32, the partition plates 311 are attached along their respective one side edges to the flat back plates 310, which are previously secured to a wall surface or the like of an acoustic room, at equal intervals. Then, the front plates 312, each of which has a width corresponding to the interval between the adjacent partition plates 311, are attached to the other side edges of the partition plates 311 so that each of the front plates 312 is supported by the other edges of the adjacent partition plates 311. Here, the front plates 312 differ from each other in length (i.e., dimension in a direction normal to the sheet of FIG. 32) as with the pipes employed in the above-described embodiments, and each of the front plates 312 has a side opening 13*a* (FIG. 31). Thus attaching the front plates 312 forms a number of inner cavities extending along the length of the plates 312 (i.e., in a direction normal to the sheet of FIG. 32). Then, respective one ends of the inner cavities are closed with the closure plates 313, so that the modified sound radiating structure 315 similar to the above-described embodiments can be provided. This sound radiating structure 315 can be constructed with only simplified operations and hence at reduced costs. If arrangements are made such that the front plates 312 and closure plates 313 can be detachably attached, the positions of the openings etc. in the sound radiating structure 315 are readily adjustable.

Furthermore, whereas the thus-constructed sound radiating structure 315 is shown in the figure as installed on the wall surface of the acoustic room, it may be embedded in the wall surface in such a manner that the front or exposed surface of the radiating structure 315 lies flush with the wall surface. In this way, the acoustic room in which the sound radiating structure 315 can present a neat appearance with no unwanted projections into the interior of the room. Furthermore, the acoustic room may be built with the wall having the radiating structure 315 previously embedded therein, which can reduce the necessary costs.

(Modification 8)

Figure 33:
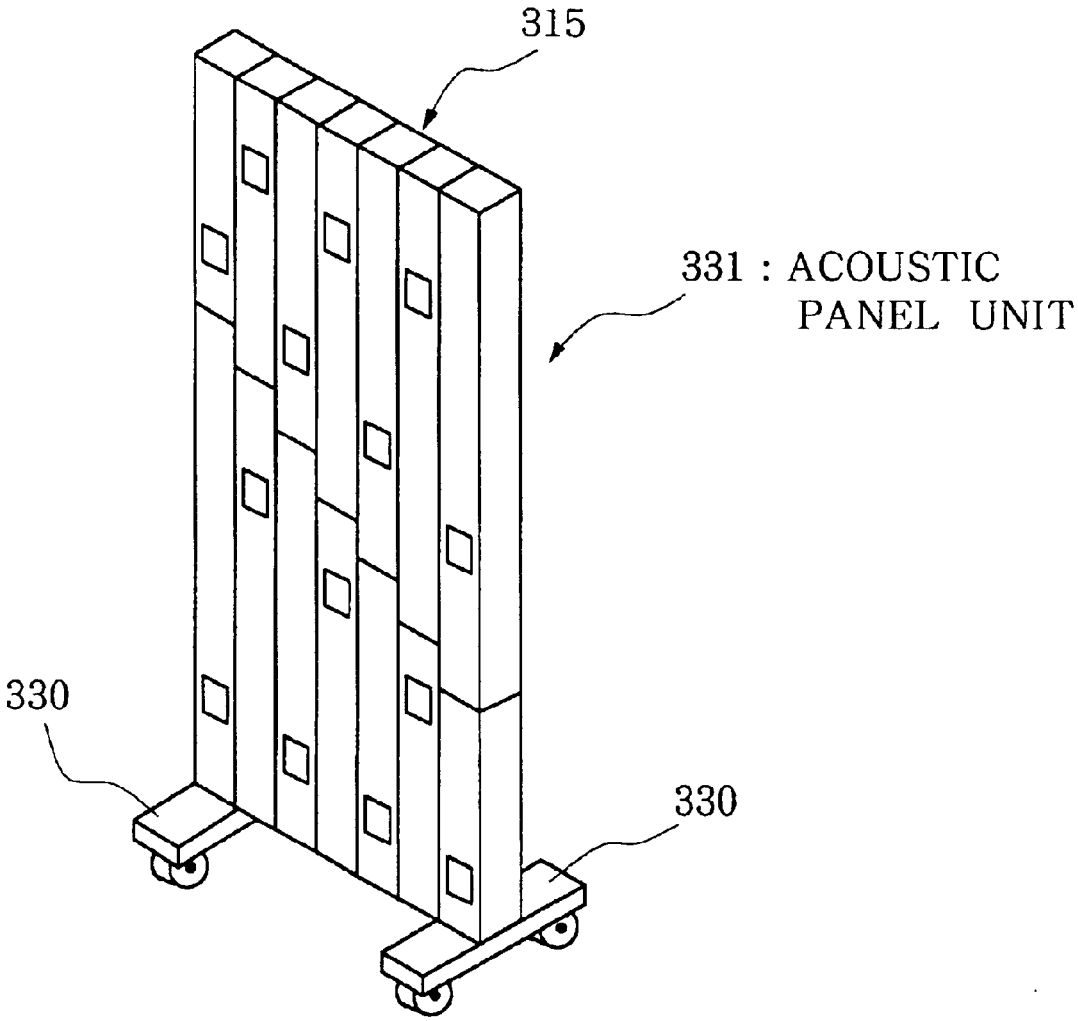
FIG. 33 is a perspective view showing another modification of the sound radiating structure of the invention.

Furthermore, whereas the sound radiating structure in accordance with the embodiments of the invention has been described as installed on the wall surface or ceiling surface, the inventive sound radiating structure (structure 315 in the illustrated example) may further include casters 330 mounted on the underside thereof, as illustrated in FIG. 33. In this way, the sound radiating structure can be provided as an acoustic panel unit 331 that has an independent sound scattering capability and is movable easily to any desired places. Such an easily-movable acoustic panel unit 331, which can of course be installed in any place where reflected sounds are to be lessened, may also be used in the following applications.

Namely, where there are two or more human players or musical sound sources, the movable acoustic panel unit 331 may be installed between these human players (or musical sources) and used as a partition to avoid sounds from going around to a weak-sound musical instrument in a recording studio, concert hall, auditorium or the like. Also, the acoustic panel unit 331 may be used as a moving-type simplified reflecting panel that is intended for reinforcing initial reflected sounds (flat-type scattered sound reflecting panel).

(Modification 9)

Figure 34:
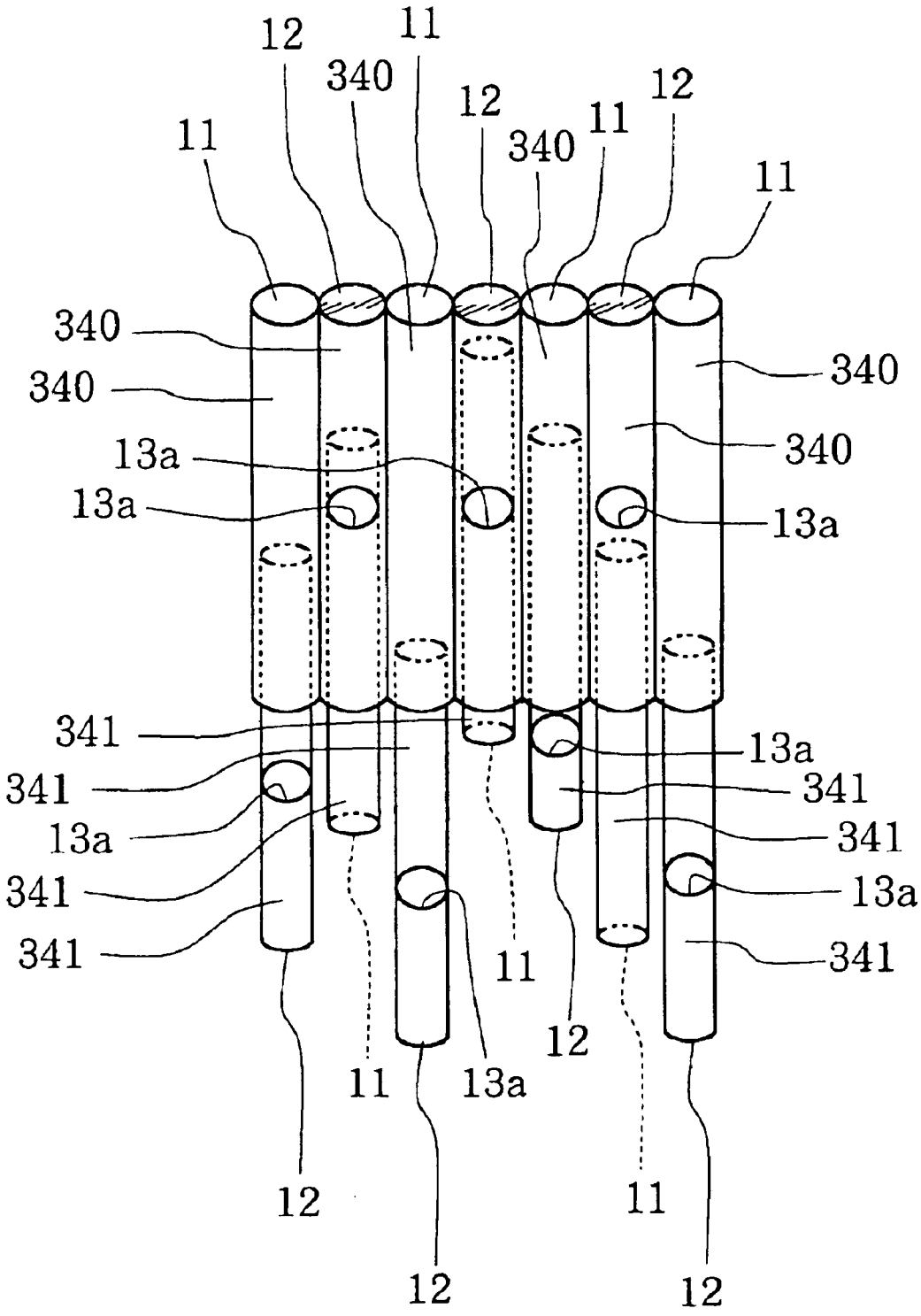
FIG. 34 is a perspective view showing still another modification of the sound radiating structure of the invention.

Furthermore, whereas each of the pipes of the inventive sound scattering structure has been described as having a fixed or non-variable length, each of the pipes may be constructed so that its length can be adjusted as appropriate. For example, as shown in FIG. 34, each of the pipes of the inventive sound scattering structure may be constructed as a telescopic pipe which comprises a fixed pipe member 340 and a movable pipe member 341 received in the fixed pipe member 340 for vertical sliding movement relative to thereto. In this instance, the length of each of the pipes can be readily adjusted by varying the position of the movable pipe member 341 relative to the fixed pipe member 340. With this arrangement, the length of each of the pipes can be adjusted in accordance with a frequency band for which good sound scattering characteristics are to be attained by the radiating structure. If the pipes are constructed to be adjustable in length as in the illustrated example of FIG. 34, the side opening 13*a* may be formed at a position corresponding to three quarters of the maximum pipe length L (i.e., length when the movable pipe member 341 is pulled out of the fixed pipe member 340 to a maximum degree) (¾ L), in which case the movable pipe member 341 may be moved relative to the fixed pipe member 340 within the limits where the side opening 13*a* are not closed.

(Modification 10)

Figure 35:
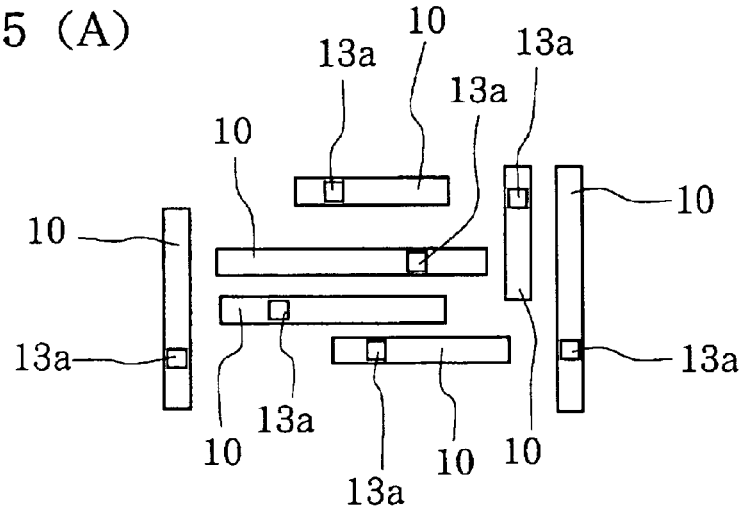
FIGS. 35A, 35B, and 35C are perspective views showing still another modification of the sound radiating structure of the invention.
Figure 35:
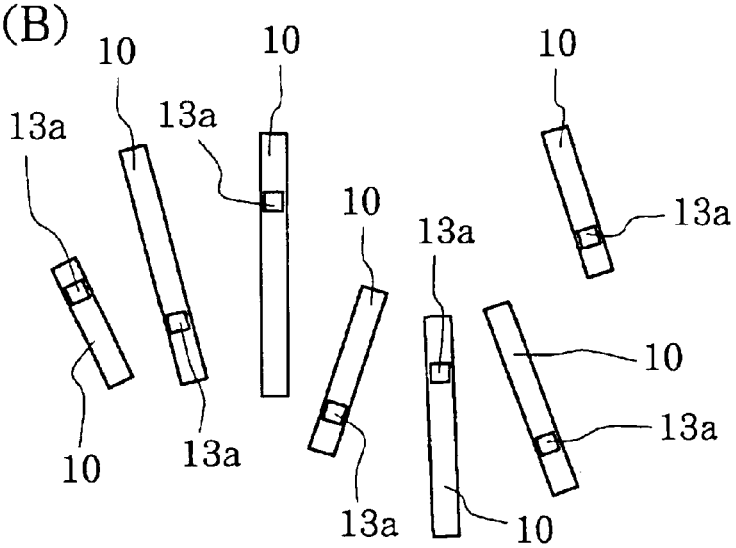
Figure 35:
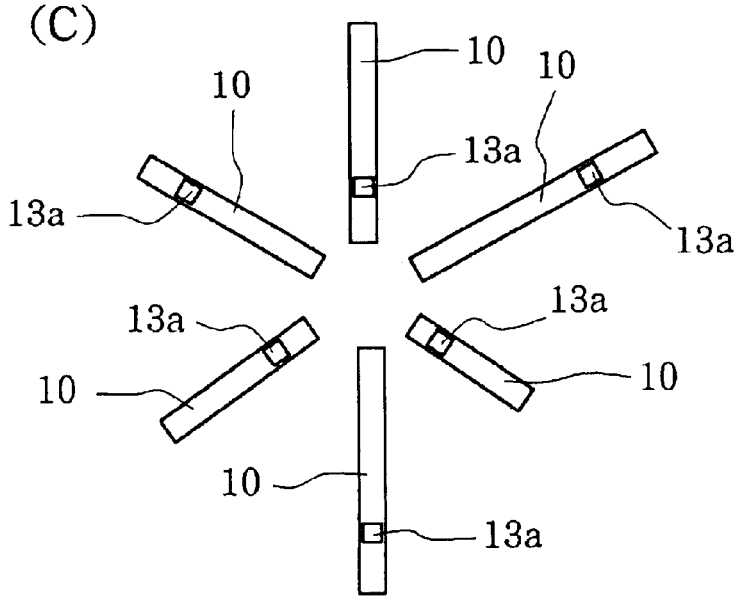
Figure 36:
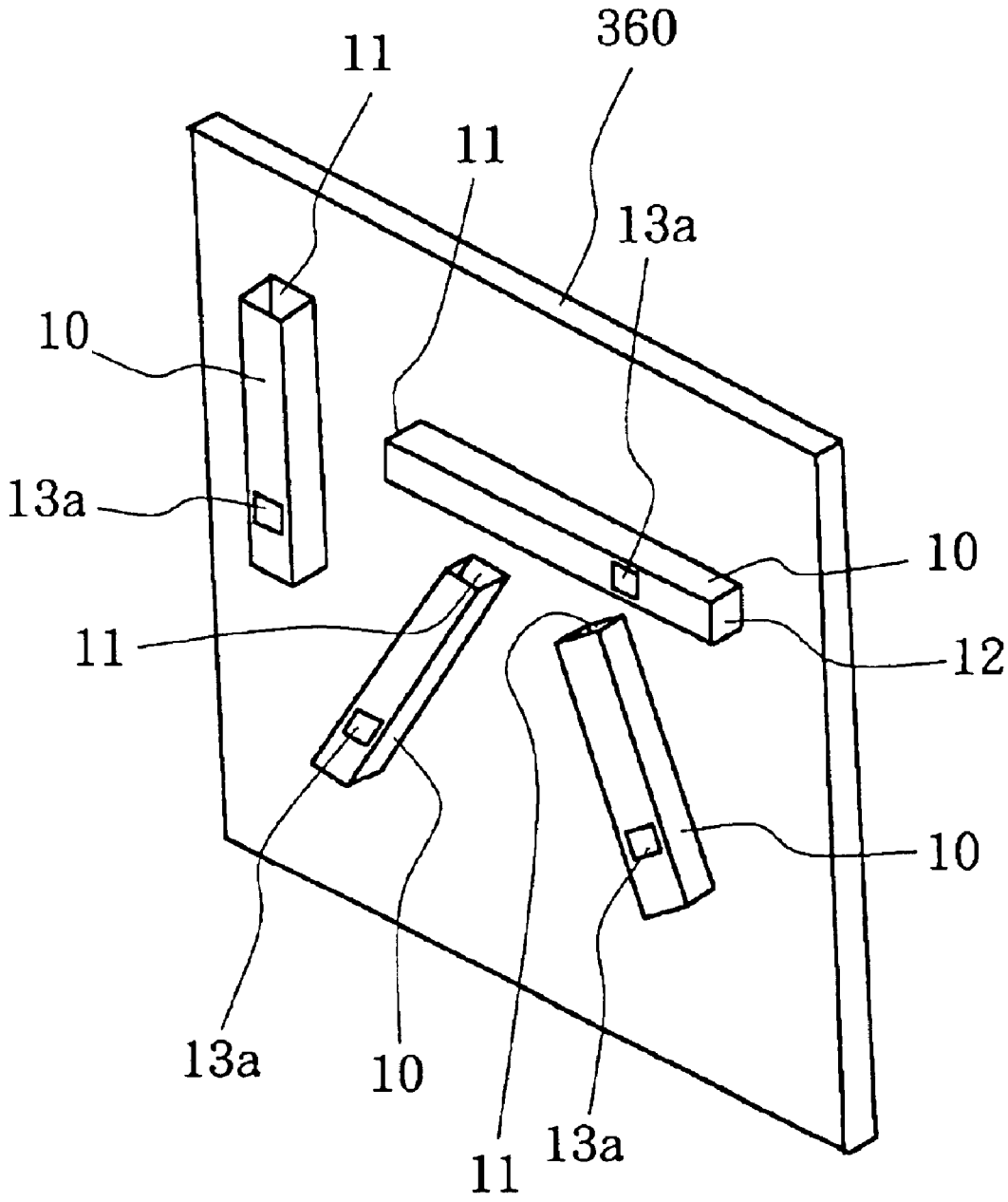
FIG. 36 is a perspective view showing still another modification of the sound radiating structure of the invention.

Furthermore, whereas the pipes in the inventive sound scattering structure have been described as being disposed in a parallel side-by-side relation, i.e. in such a manner that the pipes are located so as to adjoin each other in the direction perpendicular to the length of the pipes, the pipes may be disposed in any other orientation as long as the pipes are located adjacent to each other. For example, the pipes may be positioned as shown in FIGS. 35A, 35B and 35C. In this case, the pipes 10 may each be disposed on a wall surface or installed on a flat support panel 360, as illustrated in FIG. 36. In the case where the individual pipes are installed on the flat support panel 360, the support panel 360 may be equipped with casters so that it can be easily moved in the manner as set forth above in relation to Modification 8. Furthermore, in this case, arrangements may be made such that the position of any one of the pipes can be varied as desired.

In summary, the present invention as having been described above achieves satisfactory sound scattering effects over wide frequency bands, without involving an increase in thickness of the sound radiating structure and a decrease in the degree of flexibility in designing the interior of an acoustic room where the sound radiating structure is to be installed.

What is claimed is:

1. A sound radiating structure, comprising:

a plurality of cavity-defining members, each of said cavity-defining members being of a hollow shape to define an inner cavity that extends in a particular direction, the inner cavity defined by each of said cavity-defining members having a length in the particular direction different from lengths of inner cavities defined by other said cavity-defining members, the inner cavities defined by said cavity-defining members being located adjacent to each other such that the cavity-defining members are disposed so as to adjoin each other perpendicularly to the particular direction in which the inner cavities defined thereby extend, each of said cavity-defining members includes an open end and a closed end such that the open end and the closed end of each of said adjacent cavity-defined members are staggered, and each of said cavity-defining members includes a side portion extending along the particular direction, and the side portion includes a side opening formed therein at a position of three-quarters of the length from the open end and communicating with the inner cavity defined by each of said cavity-defining members, wherein when a sound wave is input to said sound radiating structure, each of said cavity-defining members re-radiates the sound wave by resonance.

2. A sound radiating structure as claimed in claim 1, further including a support panel on which said plurality of cavity-defining members are supported.

3. A sound radiating structure as claimed in claim 1, wherein each of said cavity-defining members includes a detachable closure provided at the closed end to close the inner cavity.

4. A sound radiating structure as claimed in claim 1, wherein each of said cavity-defining members is constructed in such a manner that the inner cavity defined thereby is adjustable in the length in the particular direction.

5. A sound radiating structure as claimed in claim 1, wherein the side portion of each of said cavity-defining members has a flat outer surface, and said plurality of cavity-defining members are disposed in such a manner that flat outer surfaces of side portions in said plurality of cavity-defining members together constitute a single substantially-continuous flat outer surface of said sound radiating structure.

6. An acoustic room, comprising:

a sound radiating structure having a plurality of cavity-defining members, each of said cavity-defining members being of a hollow shape to define an inner cavity that extends in a particular direction, the inner cavity defined by each of said cavity-defining members having a length in the particular direction different from lengths of inner cavities defined by other said cavity-defining members, the inner cavities defined by said cavity-defining members being located adjacent to each other such that the cavity-defining members are disposed so as to adjoin each other perpendicularly to the particular direction in which the inner cavities defined thereby extend, each of said cavity-defining members includes an open end and a closed end such that the open end and the closed end of each of said adjacent cavity-defined members are staggered, and each of said cavity-defining members includes a side portion extending along the particular direction, and the side portion includes a side opening formed therein at a position of three-quarters of the length from the open end and communicating with the inner cavity defined by each of said cavity-defining member, wherein when a sound wave is input to said sound radiating structure, each of said cavity-defining members re-radiates the sound wave by resonance; and an inner wall surface or ceiling surface for installation thereon of said sound radiating structure.

7. A sound radiating structure comprising:

a plurality of cavity-defining members, each of said cavity-defining members being of a hollow shape to define an inner cavity that extends in a particular direction, the inner cavity defined by each of said cavity-defining members having a length in the particular direction different from lengths of the inner cavities defined by other said cavity-defining members, the inner cavity defined by each of said cavity-defining members having an opening formed at one of opposite ends of said cavity-defining member;

the inner cavities defined by said cavity-defining members being located in such a manner that the inner cavities extend substantially in a same direction and that the end at which said opening is formed is on the opposite end to each other between adjacent ones of the cavity defining members;

wherein when a sound wave is input to said sound radiating structure, each of said cavity-defining members re-radiates the sound wave by resonance.

8. A sound radiating structure as claimed in claim 7, wherein said plurality of cavity-defining members are disposed so as to adjoin each other perpendicularly to the particular direction in which the inner cavities defined thereby extend.

9. A sound radiating structure as claimed in claim 7, which further comprises a support panel on which said plurality of cavity-defining members are supported.

10. A sound radiating structure as claimed in claim 7, wherein the inner cavity defined by each of said cavity-defining members opens outwardly at one of the opposite ends of said cavity-defining members and is closed at another of opposite ends.

11. A sound radiating structure as claimed in claim 7, wherein the inner cavity defined by each of said cavity-defining members opens outwardly at the opposite ends of said cavity-defining member, and each of said cavity-defining members includes a detachable closure provided at least one of the opposite ends for closing the inner cavity at the at least one end.

12. A sound radiating structure as claimed is in claim 7, wherein each of said cavity-defining members is constructed in such a manner that the inner cavity defined thereby is adjustable in the length in the particular direction.

13. A sound radiating structure as claimed in claim 7, wherein each of said cavity-defining members has a side portion extending along the particular direction, and the side portion has a side opening formed therein and communicating with the inner cavity defined by said cavity-defining member.

14. A sound radiating structure as claimed in claim 13, wherein the side portion of each of said cavity-defining members has a flat outer surface, and said plurality of cavity-defining members are disposed in such a manner that the flat outer surfaces of the side portions in said plurality of cavity-defining members together constitute a single substantially-continuous flat outer surface of said sound radiating structure.

15. An acoustic room comprising:

a sound radiating structure having a plurality of cavity-defining members, each of said cavity-defining members being of a hollow shape to define an inner cavity that extends in a particular direction, the inner cavity defined by each of said cavity-defining members having a length in the particular direction different from lengths of the inner cavities defined by other said cavity-defining members, the inner cavity defined by each of said cavity-defining members having an opening formed at one of opposite ends of said cavity-defining member;

the inner cavities defined by said cavity-defining members being located in such a manner that the inner cavities extend substantially in a same direction and that the end at which said opening is formed is on the opposite end to each other between adjacent ones of the cavity defining members;

wherein when a sound wave is input to said sound radiating structure, each of said cavity-defining members re-radiates the sound wave by resonance; and an inner wall surface or ceiling surface for installation thereon of said sound radiating structure.

* * * * *